US010299531B2

(12) United States Patent
Zavala et al.

(10) Patent No.: US 10,299,531 B2
(45) Date of Patent: May 28, 2019

(54) ARTICLE OF FOOTWEAR INCORPORATING A KNITTED COMPONENT FOR A HEEL PORTION OF AN UPPER

(71) Applicant: NIKE, Inc., Beaverton, OR (US)

(72) Inventors: Roberto Zavala, Portland, OR (US); Stuart W. Dealey, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 14/471,243

(22) Filed: Aug. 28, 2014

(65) Prior Publication Data

US 2015/0047225 A1 Feb. 19, 2015

Related U.S. Application Data

(63) Continuation-in-part of application No. 13/893,712, filed on May 14, 2013.

(51) Int. Cl.
*A43B 1/04* (2006.01)
*A43B 23/02* (2006.01)
(Continued)

(52) U.S. Cl.
CPC ..... *A43B 1/04* (2013.01); *A43B 1/0018* (2013.01); *A43B 23/0205* (2013.01);
(Continued)

(58) Field of Classification Search
CPC ..... A43B 1/04; A43B 1/0018; A43B 23/0205; A43B 23/0245; A43B 23/04;
(Continued)

(56) References Cited

U.S. PATENT DOCUMENTS 601,192 A 3/1898 Woodside
1,215,198 A 2/1917 Rothstein
(Continued)

FOREIGN PATENT DOCUMENTS

CN 101562999 A 10/2009
CN 102170801 A 8/2011
(Continued)

OTHER PUBLICATIONS

Decision of the Intellectual Property Office and English translation for corresponding Taiwan Application No. 103116308 dated Nov. 10, 2015, 25 pages.
(Continued)

*Primary Examiner* — Megan E Lynch
(74) *Attorney, Agent, or Firm* — Brinks Gilson & Lione

(57) ABSTRACT

An article of footwear may include an upper and a sole structure secured to the upper. The upper has a knitted component formed of unitary knit construction that includes at least one gore region located in a heel region of the article of footwear. The gore region provides a contoured configuration to the knitted component. In a method of manufacturing, a knitted component may include a first gore region and a plurality of second gore regions, with the first gore region being located in a heel area of the article of footwear and the second gore regions being located adjacent to the sole structure.

5 Claims, 21 Drawing Sheets

(51) Int. Cl.

| | |
|---|---|
| ***A43B 23/08*** | (2006.01) |
| ***A43C 11/00*** | (2006.01) |
| ***D04B 1/10*** | (2006.01) |
| ***A43B 1/00*** | (2006.01) |

(52) U.S. Cl.

CPC ..... *A43B 23/025* (2013.01); *A43B 23/0245* (2013.01); *A43B 23/088* (2013.01); *A43C 11/006* (2013.01); *D04B 1/108* (2013.01); *D10B 2403/032* (2013.01); *D10B 2501/043* (2013.01)

(58) Field of Classification Search

CPC .... A43B 23/042; A43B 23/025; D04B 1/108; D10B 2403/032; D10B 2501/043; D10B 2501/021

See application file for complete search history.

(56) References Cited

U.S. PATENT DOCUMENTS 1,597,934 A 8/1926 Stimpson
1,888,172 A 11/1932 Joha
1,902,780 A 3/1933 Holden et al.
1,910,251 A 5/1933 Joha
2,001,293 A 5/1935 Wilson
2,047,724 A 7/1936 Zuckerman
2,147,197 A * 2/1939 Glidden ..... A43B 1/02 36/3 A
2,314,098 A 3/1943 McDonald
2,330,199 A 9/1943 Basch
2,343,390 A 3/1944 Ushakoff
2,400,692 A 5/1946 Herbert
2,440,393 A 4/1948 Clark
2,569,764 A 10/1951 Jonas
2,586,045 A 2/1952 Hoza
2,608,078 A 8/1952 Anderson
2,641,004 A 6/1953 Whiting et al.
2,675,631 A 4/1954 Doughty
2,684,540 A 7/1954 Levy
2,950,611 A * 8/1960 Getaz ..... D04B 1/26 66/182
2,994,322 A 8/1961 Cullen et al.
3,130,566 A 4/1964 Chesebro
3,583,081 A 6/1971 Hayashi
3,603,116 A * 9/1971 Turini ..... D04B 9/56 66/178 R
3,694,940 A 10/1972 Stohr
3,704,474 A 12/1972 Winkler
3,766,566 A 10/1973 Tadakoro
3,778,856 A 12/1973 Christie et al.
3,952,427 A 4/1976 Von Den Benken et al.
3,972,086 A 8/1976 Belli et al.
4,027,402 A 6/1977 Liu et al.
4,031,586 A 6/1977 Von den Benken et al.
4,211,806 A 7/1980 Civardi et al.
4,232,458 A 11/1980 Bartels
4,255,949 A 3/1981 Thorneburg
4,258,480 A 3/1981 Famolare, Jr.
4,317,292 A 3/1982 Melton
4,373,361 A 2/1983 Thorneburg
4,447,967 A 5/1984 Zaino
4,465,448 A 8/1984 Aldridge
4,607,439 A 8/1986 Harada
4,737,396 A 4/1988 Kamat
4,750,339 A 6/1988 Simpson et al.
4,756,098 A 7/1988 Boggia
4,785,558 A 11/1988 Shiomura
4,813,158 A 3/1989 Brown
5,031,423 A 7/1991 Ikenaga
5,095,720 A 3/1992 Tibbals, Jr.
5,103,656 A * 4/1992 Hanson, II ..... A41B 11/003 2/239
5,117,567 A 6/1992 Berger
5,152,025 A 10/1992 Hirmas
5,185,000 A * 2/1993 Brandt ..... A61F 5/0111 2/22
5,192,601 A 3/1993 Neisler
5,345,638 A 9/1994 Nishida
5,353,524 A 10/1994 Brier
5,371,957 A 12/1994 Gaudio
5,461,884 A 10/1995 McCartney et al.
5,511,323 A 4/1996 Dahlgren
5,572,860 A 11/1996 Mitsumoto et al.
5,575,090 A 11/1996 Condini
5,623,840 A 4/1997 Roell
5,729,918 A 3/1998 Smets
5,735,145 A 4/1998 Pernick
5,737,943 A * 4/1998 Bernhardt ..... A41B 11/00 2/239
5,746,013 A 5/1998 Fay, Sr.
5,765,296 A 6/1998 Ludemann et al.
5,884,419 A 3/1999 Davidowitz et al.
5,996,189 A 12/1999 Wang
6,029,376 A 2/2000 Cass
6,032,387 A 3/2000 Johnson
6,052,921 A 4/2000 Oreck
6,088,936 A 7/2000 Bahl
6,116,057 A * 9/2000 Roell ..... D04B 1/22 66/64
6,151,802 A 11/2000 Reynolds
6,170,175 B1 1/2001 Funk
6,178,781 B1 * 1/2001 Myers ..... D04B 1/108 66/178 R
6,178,785 B1 * 1/2001 Samata ..... D04B 1/26 2/239
6,308,438 B1 10/2001 Throneburg et al.
6,333,105 B1 12/2001 Tanaka et al.
6,401,364 B1 6/2002 Burt
6,558,784 B1 5/2003 Norton et al.
6,588,237 B2 7/2003 Cole et al.
6,754,983 B2 6/2004 Hatfield et al.
6,910,288 B2 6/2005 Dua
6,922,917 B2 8/2005 Kerns et al.
6,931,762 B1 8/2005 Dua
D517,297 S 3/2006 Jones et al.
7,051,460 B2 5/2006 Orei et al.
7,056,402 B2 6/2006 Koerwien et al.
7,347,011 B2 2/2008 Dua et al.
7,441,348 B1 10/2008 Dawson
7,543,397 B2 6/2009 Kilgore et al.
7,568,298 B2 8/2009 Kerns
7,682,219 B2 3/2010 Falla
8,490,299 B2 7/2013 Dua et al.
2002/0078599 A1 6/2002 Delgorgue et al.
2002/0148258 A1 10/2002 Cole et al.
2003/0089136 A1 * 5/2003 Lynch ..... A41B 11/005 66/187
2003/0126762 A1 7/2003 Tseng
2003/0191427 A1 10/2003 Jay et al.
2004/0118018 A1 6/2004 Dua
2004/0181972 A1 9/2004 Csorba
2004/0261466 A1 * 12/2004 Takeda ..... A41B 11/00 66/176
2005/0115284 A1 * 6/2005 Dua ..... A43B 1/04 66/178 R
2005/0193592 A1 9/2005 Dua et al.
2005/0235701 A1 * 10/2005 Miyai ..... A41D 19/00 66/174
2005/0273988 A1 12/2005 Christy
2005/0284000 A1 12/2005 Kerns
2006/0010931 A1 * 1/2006 Lynch ..... A41B 11/005 66/185
2006/0059715 A1 3/2006 Aveni
2006/0085894 A1 * 4/2006 Yakopson ..... A61F 13/08 2/239
2006/0130359 A1 6/2006 Dua et al.
2006/0162187 A1 7/2006 Byrnes et al.
2007/0022627 A1 2/2007 Sokolowski et al.
2007/0180730 A1 8/2007 Greene et al.
2007/0294920 A1 12/2007 Baychar
2008/0017294 A1 1/2008 Bailey et al.

(56) References Cited

U.S. PATENT DOCUMENTS

| | | | | |
|---|---|---|---|---|
| 2008/0041113 | A1* | 2/2008 | Mori | A41B 11/02 66/54 |
| 2008/0078102 | A1 | 4/2008 | Kilgore et al. | |
| 2008/0110048 | A1 | 5/2008 | Dua et al. | |
| 2008/0110049 | A1 | 5/2008 | Sokolowski et al. | |
| 2008/0189830 | A1 | 8/2008 | Egglesfield | |
| 2008/0313939 | A1 | 12/2008 | Ardill | |
| 2009/0068908 | A1 | 3/2009 | Hinchcliff | |
| 2009/0282607 | A1* | 11/2009 | Kaneda | A41B 11/02 2/239 |
| 2010/0037370 | A1* | 2/2010 | Busi | D04B 1/108 2/239 |
| 2010/0051132 | A1 | 3/2010 | Glenn | |
| 2010/0154256 | A1 | 6/2010 | Dua | |
| 2010/0170651 | A1 | 7/2010 | Scherb et al. | |
| 2011/0030244 | A1 | 2/2011 | Motawi et al. | |
| 2011/0078921 | A1 | 4/2011 | Greene et al. | |
| 2011/0099848 | A1 | 5/2011 | Tomat et al. | |
| 2011/0302699 | A1* | 12/2011 | Kaneda | D04B 1/108 2/239 |
| 2012/0233882 | A1 | 9/2012 | Huffa et al. | |
| 2012/0246973 | A1 | 10/2012 | Dua | |
| 2012/0255201 | A1* | 10/2012 | Little | A43B 1/04 36/84 |
| 2012/0284902 | A1* | 11/2012 | Matsuo | D04B 1/265 2/239 |
| 2013/0031937 | A1* | 2/2013 | Beckler | D04B 1/108 66/51 |
| 2013/0205839 | A1* | 8/2013 | Fukui | D04B 1/02 66/185 |
| 2014/0101816 | A1 | 4/2014 | Toronjo | |
| 2014/0150292 | A1 | 6/2014 | Podhajny et al. | |
| 2014/0245634 | A1* | 9/2014 | Podhajny | A43B 23/0245 36/54 |
| 2014/0317833 | A1* | 10/2014 | Craig | A41B 11/00 2/239 |
| 2014/0377488 | A1* | 12/2014 | Jamison | A43B 1/04 428/36.1 |
| 2015/0000009 | A1* | 1/2015 | Koshida | A41B 11/00 2/239 |
| 2015/0082836 | A1* | 3/2015 | Riaz | D04B 1/26 66/187 |
| 2016/0198797 | A1 | 7/2016 | Ikenaka | |

FOREIGN PATENT DOCUMENTS

| | | | | |
|---|---|---|---|---|
| DE | 457363 | C | 4/1929 | |
| DE | 475363 | | 4/1929 | |
| DE | 870963 | C | 3/1953 | |
| DE | 1084173 | | 6/1960 | |
| DE | 19738433 | | 4/1998 | |
| DE | 19728848 | | 1/1999 | |
| EP | 0279950 | A2 | 8/1988 | |
| EP | 0448714 | | 7/1996 | |
| EP | 0728860 | | 8/1996 | |
| EP | 0758693 | | 2/1997 | |
| EP | 0898002 | A2 | 2/1999 | |
| EP | 1233091 | | 8/2002 | |
| EP | 1437057 | A1 | 7/2004 | |
| EP | 1563752 | A1 | 8/2005 | |
| EP | 1602762 | A1 | 12/2005 | |
| EP | 1972706 | A1 | 9/2008 | |
| EP | 2865798 | A1 * | 4/2015 | D04B 1/108 |
| FR | 2171172 | | 9/1973 | |
| GB | 538865 | | 8/1941 | |
| GB | 643759 | A | 9/1950 | |
| GB | 2018837 | A | 10/1979 | |
| GB | 1603487 | | 11/1981 | |
| JP | H06113905 | | 4/1994 | |
| JP | H08109553 | | 4/1996 | |
| JP | H11302943 | | 11/1999 | |
| JP | WO 2008120476 | A1 * | 10/2008 | D04B 1/26 |
| JP | WO 2009022535 | A1 * | 2/2009 | D04B 1/108 |
| JP | 2011-92724 | | 5/2011 | |
| NL | 7304678 | | 10/1974 | |
| WO | 9003744 | | 4/1990 | |
| WO | 0032861 | | 6/2000 | |
| WO | 0231247 | | 4/2002 | |
| WO | WO 2009/117976 | A1 | 10/2009 | |
| WO | WO 2014/050289 | A1 | 4/2014 | |
| WO | WO 2014/131762 | A2 | 9/2014 | |

OTHER PUBLICATIONS

International Preliminary Report on Patentability dated Nov. 17, 2015, 7 pages.

International Search Report and Written Opinion for corresponding PCT/US2015/045230 dated Mar. 2, 2016, 18 pages.

International Preliminary Report on Patentability for PCT/US2014/037768 dated Nov. 17, 2015, 7 pages (Reference Was Previously Submitted on Jan. 22, 2016).

Declaration of Dr. Edward C. Frederick from the US Patent and Trademark Office Inter Partes Review of U.S. Pat. No. 7,347,011 (178 pp).

David J. Spencer, Knitting Technology: A Comprehensive Handbook and Practical Guide (Third ed., Woodhead Publishing Ltd. 2001) (413 pp).

Excerpt of Hannelore Eberle et al., Clothing Technology (Third English ed., Beuth-Verlag GmnH 2002) (book cover and back; pp. 2-3, 83).

International Search Report and Written Opinion in connection with PCT/US2009/056795 dated Apr. 20, 2010.

International Search Report and Written Opinion in connection with PCT/US2012/028576 dated Oct. 1, 2012.

International Search Report and Written Opinion in connection with PCT/US2012/028559 dated Oct. 19, 2012.

International Search Report and Written Opinion in connection with PCT/US2012/028534 dated Oct. 17, 2012.

International Preliminary Report on Patentability in connection with PCT/US2012/028534 dated Sep. 17, 2013.

International Preliminary Report on Patentability in connection with PCT/US2012/028576 dated Sep. 17, 2013.

International Search Report and Written Opinion for Application No. PCT/US2014/037768, dated Sep. 10, 2014.

Allowance Decision and English translation for corresponding ROC (Taiwan) Patent Application No. 103116308 dated Jul. 27, 2016, 4 pages.

Office Action and English translation for corresponding ROC (Taiwan) Patent Application No. 104128542 dated Jan. 23, 2017, 11 pages.

Office Action and English translation of ROC (Taiwan) Patent Application No. 104128542 dated Jul. 24, 2017, 13 pages.

Office Action and English translation of Chinese Patent Application No. 2015800462075, dated Feb. 24, 2018, 11 pages.

Office Action and English translation of corresponding Korean Application No. 10-2017-7007886, dated Oct. 5, 2018, 12 pages.

Office Action and English translation for Japanese Application No. 2017-511639, dated Jun. 14, 2018, 12 pages.

Office Action and English translation of relevant portions for Chinese Application No. 2015800462075, dated Jul. 31, 2018, 6 pages.

Office Action and English translation of relevant portions for corresponding Chinese Application No. 2015800462075, dated Jan. 16, 2019, 9 pages.

* cited by examiner

ARTICLE OF FOOTWEAR INCORPORATING A KNITTED COMPONENT FOR A HEEL PORTION OF AN UPPER

CROSS-REFERENCE TO RELATED APPLICATION

This U.S. patent application is a continuation-in-part application and claims priority under 35 U.S.C. § 120 to U.S. patent application Ser. No. 13/893,712, which was filed in the U.S. Patent and Trademark Office on 14 May 2013 and entitled Article Of Footwear Having Heel Portion With Knitted Component, such prior U.S. patent application being entirely incorporated herein by reference.

BACKGROUND

Conventional articles of footwear generally include two primary elements: an upper and a sole structure. The upper is secured to the sole structure and forms a void within the footwear for comfortably and securely receiving a foot. The sole structure is secured to a lower surface of the upper so as to be positioned between the upper and the ground. In some articles of athletic footwear, for example, the sole structure may include a midsole and an outsole. The midsole may be formed from a polymer foam material that attenuates ground reaction forces to lessen stresses upon the foot and leg during walking, running, and other ambulatory activities. The outsole is secured to a lower surface of the midsole and forms a ground-engaging portion of the sole structure that is formed from a durable and wear-resistant material. The sole structure may also include a sockliner positioned within the void and proximal a lower surface of the foot to enhance footwear comfort.

The upper generally extends over the instep and toe areas of the foot, along the medial and lateral sides of the foot, and around the heel area of the foot. In some articles of footwear, such as basketball footwear and boots, the upper may extend upward and around the ankle to provide support or protection for the ankle. Access to the void on the interior of the upper is generally provided by an ankle opening in a heel region of the footwear. A lacing system is often incorporated into the upper to adjust the fit of the upper, thereby permitting entry and removal of the foot from the void within the upper. The lacing system also permits the wearer to modify certain dimensions of the upper, particularly girth, to accommodate feet with varying dimensions. In addition, the upper may include a tongue that extends under the lacing system to enhance adjustability of the footwear, and the upper may incorporate a heel counter to limit movement of the heel.

Various materials are conventionally utilized in manufacturing the upper. The upper of athletic footwear, for example, may be formed from multiple material elements. The materials may be selected based upon various properties, including stretch-resistance, wear-resistance, flexibility, air-permeability, compressibility, and moisture-wicking, for example. With regard to an exterior of the upper, the toe area and the heel area may be formed of leather, synthetic leather, or a rubber material to impart a relatively high degree of wear-resistance. Leather, synthetic leather, and rubber materials may not exhibit the desired degree of flexibility and air-permeability for various other areas of the exterior. Accordingly, the other areas of the exterior may be formed from a synthetic textile, for example. The exterior of the upper may be formed, therefore, from numerous material elements that each imparts different properties to the upper.

An intermediate or central layer of the upper may be formed from a lightweight polymer foam material that provides cushioning and enhances comfort. Similarly, an interior of the upper may be formed of a comfortable and moisture-wicking textile that removes perspiration from the area immediately surrounding the foot. The various material elements and other components may be joined with an adhesive or stitching. Accordingly, the conventional upper is formed from various material elements that each imparts different properties to various areas of the footwear.

SUMMARY

An article of footwear is disclosed that includes a sole structure and an upper coupled to the sole structure. The upper includes a lower edge that is disposed adjacent to the sole structure. The upper further includes a collar defining an opening to a void within the upper. The collar defines an upper edge of the upper that is spaced away from the lower edge. The upper includes a forward portion and a heel portion. The heel portion includes a knitted component of unitary knit construction. The knitted component at least partially defines the upper edge and the lower edge of the upper. The knitted component includes a first side edge that is attached to the forward portion along a first side. The knitted component also includes a second side edge that is attached to the forward portion along a second side.

Also, an article of footwear is disclosed that includes a sole structure and an upper coupled to the sole structure. The upper includes a forward portion formed of a first component and a heel portion formed of a second component, the first component being separate from the second component. The forward portion and the heel portion being joined to each other along at least one seam. The heel portion includes a heel knitted component of unitary knit construction. The heel knitted component has a first knitted zone associated with a first amount of stretch resistance and a second knitted zone associated with a second amount of stretch resistance. The first amount of stretch resistance of the first knitted zone is larger than the second amount of stretch resistance of the second knitted zone.

Moreover, an article of footwear is disclosed that includes a sole structure and an upper coupled to the sole structure. The upper includes a lower edge that is disposed adjacent the sole structure. The upper includes a collar defining an opening to a void within the upper. The collar defines an upper edge of the upper that is spaced away from the lower edge. The upper also includes a forward portion including a forward knitted component of unitary knit construction. Additionally, the upper includes a heel portion including a heel knitted component of unitary knit construction. The heel portion has a first knitted zone, a second knitted zone, and a third knitted zone. The first knitted zone is associated with a first amount of stretch resistance, the second knitted zone is associated with a second amount of stretch resistance, and the third knitted zone is associated with a third amount of stretch resistance. The first amount of stretch resistance is larger than the second amount of stretch resistance, and the second amount of stretch resistance is larger than the third amount of stretch resistance. The third knitted zone partially defines the collar and the upper edge. The first knitted zone partially defines the lower edge. The second knitted zone is cooperatively surrounded by the first knitted zone and the third knitted zone. The heel knitted component includes a first edge that is joined via stitching to the forward knitted component on a medial side of the upper. The heel knitted component further includes a second edge that is joined via stitching to the forward knitted component on a lateral side of the upper.

Other systems, methods, features and advantages of the present disclosure will be, or will become, apparent to one of ordinary skill in the art upon examination of the following figures and detailed description. It is intended that all such additional systems, methods, features and advantages be included within this description and this summary, be within the scope of the present disclosure, and be protected by the following claims.

BRIEF DESCRIPTION OF THE DRAWINGS

The present disclosure can be better understood with reference to the following drawings and description. The components in the figures are not necessarily to scale, emphasis instead being placed upon illustrating the principles of the present disclosure. Moreover, in the figures, like reference numerals designate corresponding parts throughout the different views.

DETAILED DESCRIPTION

The following discussion and accompanying figures disclose an article of footwear having an upper that includes at least one knitted component. The article of footwear is disclosed as having a general configuration suitable for walking or running. Concepts associated with the footwear, including the upper, may also be applied to a variety of other athletic footwear types, including baseball shoes, basketball shoes, cross-training shoes, cycling shoes, football shoes, soccer shoes, sprinting shoes, tennis shoes, and hiking boots, for example. The concepts may also be applied to footwear types that are generally considered to be non-athletic, including dress shoes, loafers, sandals, and work boots. The concepts disclosed herein apply, therefore, to a wide variety of footwear types.

Footwear Configurations

Figure 1:
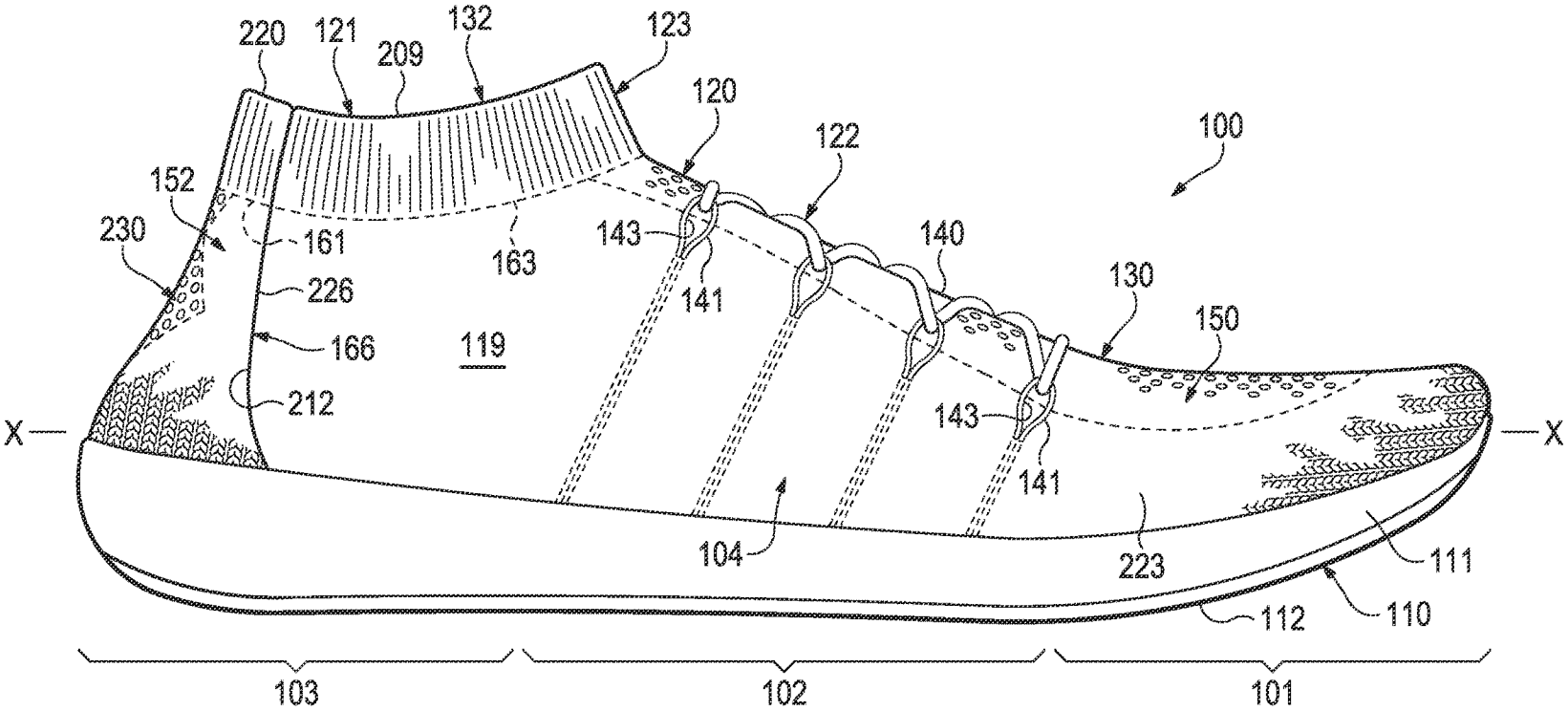
FIG. 1 is a lateral side view of an article of footwear according to exemplary embodiments of the present disclosure.
Figure 2:
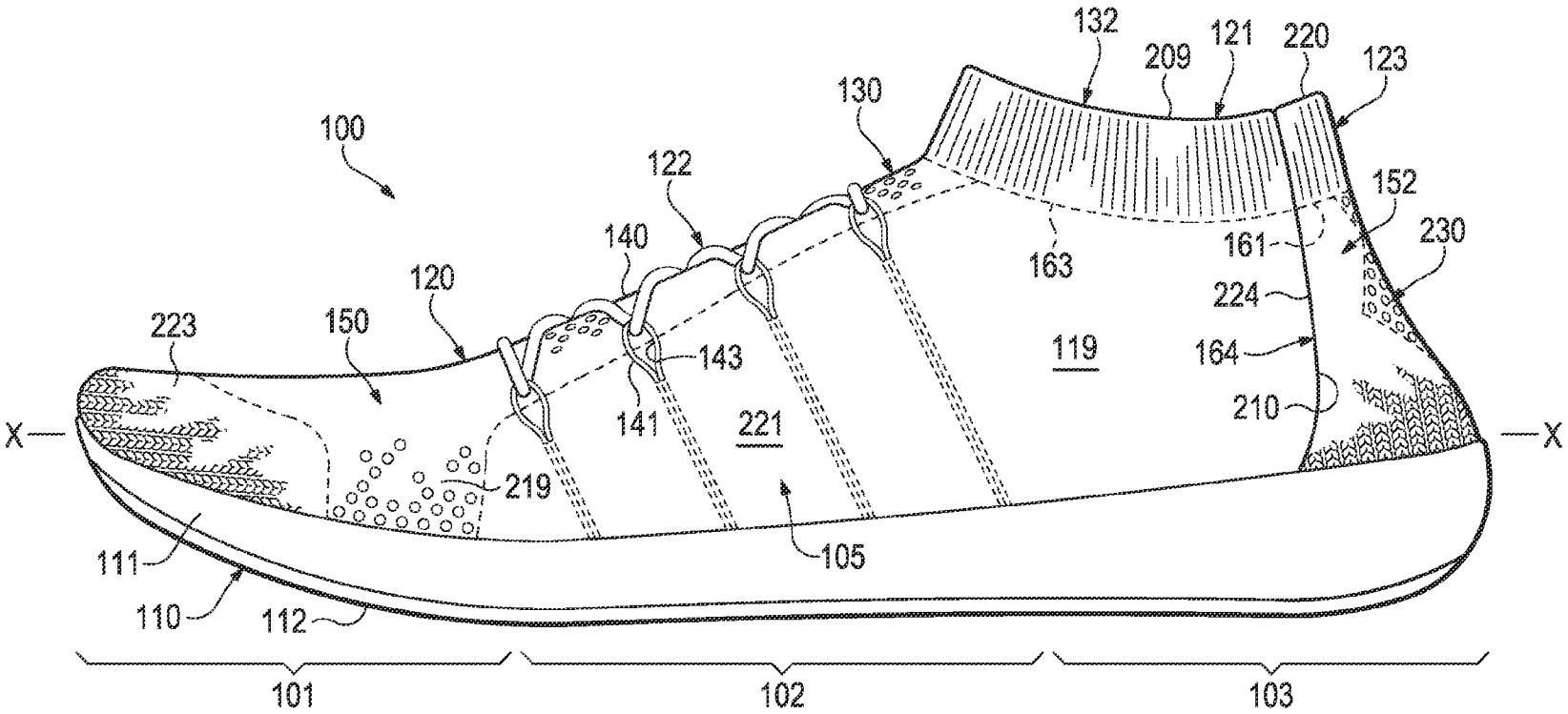
FIG. 2 is a medial side view of the article of footwear of FIG. 1.
Figure 3:
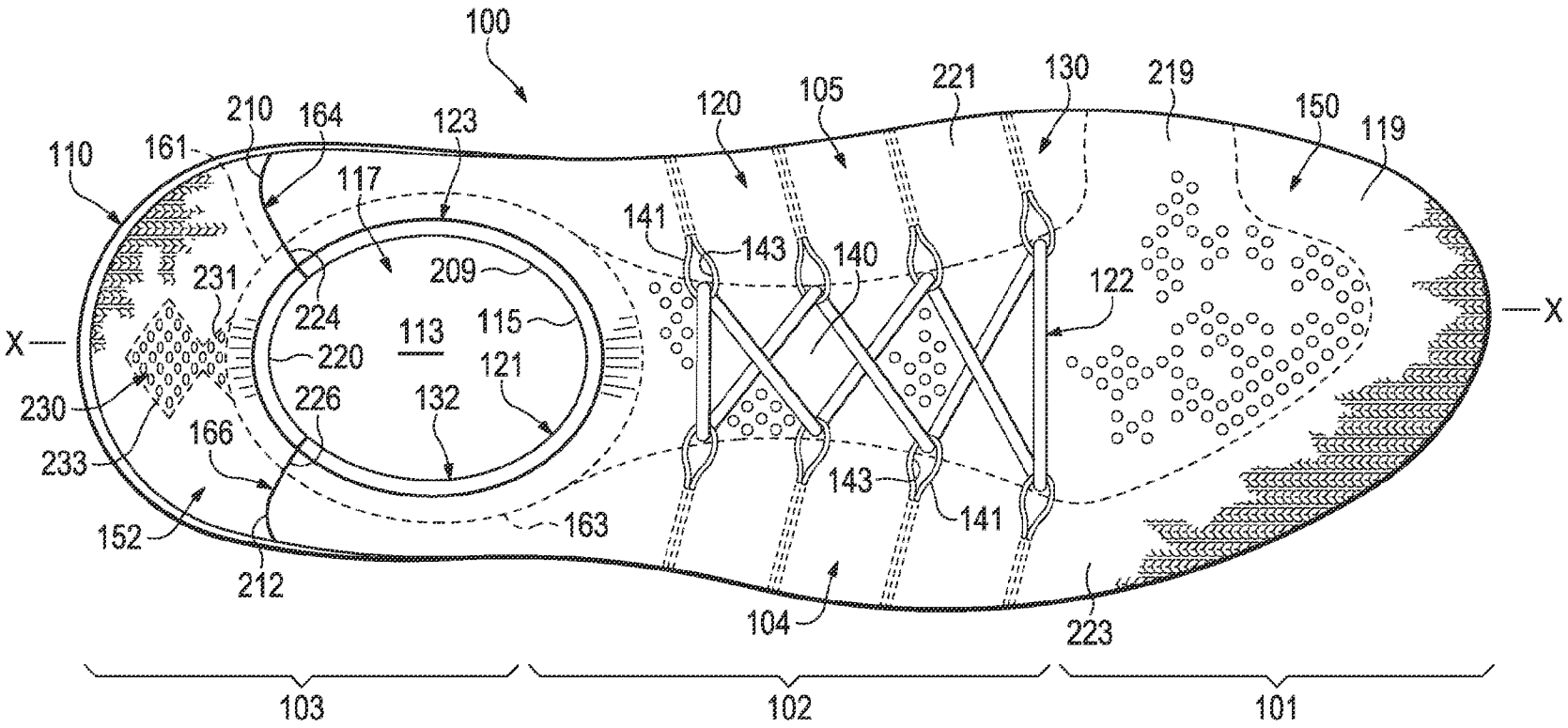
FIG. 3 is a top view of the article of footwear of FIG. 1.

FIGS. 1 through 3 illustrate exemplary embodiments of an article of footwear 100, also referred to simply as footwear 100. In some embodiments, article of footwear 100 may generally include a sole structure 110 and an upper 120.

For reference purposes, footwear 100 may be divided generally along a longitudinal axis X into three general regions: a forefoot region 101, a midfoot region 102, and a heel region 103. Forefoot region 101 generally includes portions of footwear 100 corresponding with the toes and the joints connecting the metatarsals with the phalanges. Midfoot region 102 generally includes portions of footwear 100 corresponding with an arch area of the foot. Heel region 103 generally corresponds with rear portions of the foot, including the calcaneus bone. Footwear 100 also includes a lateral side 104 and a medial side 105, which extend through each of forefoot region 101, midfoot region 102, and heel region 103 and correspond with opposite sides of footwear 100. More particularly, lateral side 104 corresponds with an outside area of the foot (i.e., the surface that faces away from the other foot), and medial side 105 corresponds with an inside area of the foot (i.e., the surface that faces toward the other foot). Forefoot region 101, midfoot region 102, and heel region 103 and lateral side 104, medial side 105 are not intended to demarcate precise areas of footwear 100. Rather, forefoot region 101, midfoot region 102, and heel region 103 and lateral side 104, medial side 105 are intended to represent general areas of footwear 100 to aid in the following discussion. In addition to footwear 100, forefoot region 101, midfoot region 102, and heel region 103 and lateral side 104, medial side 105 can also independently refer to sole structure 110, upper 120, and individual elements thereof.

Sole structure 110 can be secured to upper 120 and can extend between the foot and the ground when footwear 100 is worn. In some embodiments, the sole structure 110 can generally include a midsole 111 and an outsole 112.

Midsole 111 can be secured to a lower surface of upper 120 and may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In additional embodiments, midsole 111 may incorporate plates, moderators, fluid-filled chambers, lasting elements, or motion control members that further attenuate forces, enhance stability, or influence the motions of the foot. Midsole 111 can also be primarily formed from a fluid-filled chamber.

Outsole 112 can be secured to a lower surface of midsole 111. Outsole 112 can also be formed from a wear-resistant rubber material that is textured to impart traction.

The sole structure 110 can further include a sockliner 113 in some embodiments. Sockliner 113 is shown partially in FIG. 3. Sockliner 113 can be located within upper 120 and can be positioned to extend under a lower surface of the foot to enhance the comfort of footwear 100.

Although this configuration for sole structure 110 provides an example of a sole structure 110 that may be used in connection with upper 120, a variety of other conventional or nonconventional configurations for sole structure 110 may also be used. Accordingly, in other embodiments, the features of sole structure 110 or any sole structure used with upper 120 may vary.

Upper 120 will now be discussed generally. Upper 120 can define a void 117 within footwear 100 for receiving and securing a foot relative to sole structure 110. Void 117 is shaped to accommodate the foot and extends along a lateral side of the foot, along a medial side of the foot, over the foot and toes, around the heel, and under the foot.

Upper 120 can define a collar 130 with an upper edge 132 that defines an opening 121. Opening 121 can provide access to void 117 for the wearer's foot and can be located, at least, in heel region 103.

A tongue 140 can be included forward of collar 130 and can extend longitudinally toward forefoot region 101 and between lateral side 104 and medial side 105. As shown in the illustrated embodiments, tongue 140 can be integrally attached to forefoot region 101, lateral side 104, and medial side 105. In other embodiments, tongue 140 can be detached from lateral side 104 and medial side 105. As such, tongue 140 can be moveably received within an open throat area of upper 120 between lateral side 104 and medial side 105.

In some embodiments, closure element 122 can also be included that is used to selectively secure upper 120 to the wearer's foot. Closure element 122 can be of any suitable type, such as a lace as shown in the illustrated embodiments. In other embodiments, closure element 122 may also include one or more buckles, straps, or other suitable implements for securing upper 120 to a wearer's foot.

In an exemplary embodiment, closure element 122 may be configured to interact with tensile strands 141 to assist with securing upper 120 to a wearer's foot. In the illustrated embodiment, upper 120 includes a plurality of tensile strands 141 that extend upward along upper 120 from sole structure 110 and extend back down forming looped ends to provide apertures 143 that receive closure element 122. Tensile strands 141 suitable for use with upper 120 may include the tensile strands and/or tensile elements disclosed in one or more of commonly-owned U.S. patent application Ser. No. 12/338,726 to Dua et al., entitled "Article of Footwear Having An Upper Incorporating A Knitted Component", filed on Dec. 18, 2008 and published as U.S. Patent Application Publication Number 2010/0154256 on Jun. 24, 2010, and U.S. patent application Ser. No. 13/048,514 to Huffa et al., entitled "Article Of Footwear Incorporating A Knitted Component", filed on Mar. 15, 2011 and published as U.S. Patent Application Publication Number 2012/0233882 on Sep. 20, 2012, both of which applications are hereby incorporated by reference in their entirety.

In this embodiment, apertures 143 provided by strands 141 are spaced apart along axis X and between lateral side 104 and medial side 105. Accordingly, closure element 122 extends along axis X and alternates between lateral side 104 and medial side 105. By tensioning closure element 122, the wearer can modify dimensions of upper 120 to accommodate proportions of the foot. More particularly, closure element 122 can permit the wearer to tighten upper 120 around the foot, and closure element 122 can permit the wearer to loosen upper 120 to facilitate entry and removal of the foot from void 117 through opening 121.

In some configurations, upper 120 can also extend at least partially under the wearer's foot. For example, sole structure 110 is removed in FIG. 4, and as shown upper 120 can include a strobel 125 that is attached along a periphery to a lower edge 160. Strobel 125 can be attached via stitching 162 as shown in the illustrated embodiments, via fasteners, via adhesives, or via another attachment device. Accordingly, strobel 125 extends under the wearer's foot. As mentioned above, sole structure 110 can include a sockliner 113 and midsole 111. In these embodiments, sockliner 113 can be layered over an upper surface of strobel 125 within void 117, and midsole 111 can be joined to a lower surface of strobel 125.

In further configurations, upper 120 may include additional elements. For example, upper 120 can include a toe guard in forefoot region 101 that is formed of a wear-resistant material. Upper 120 can additionally include logos, trademarks, symbols, and placards with care instructions and material information. Those having ordinary skill in the art will appreciate that upper 120 can include still further elements without departing from the scope of the present disclosure.

Many conventional footwear uppers are formed from multiple material elements (e.g., polymer foam, polymer sheets, leather, synthetic leather) that are joined together through stitching or bonding, for example. However, in various embodiments discussed herein, upper 120 can be at least partially formed from a knitted component 130. Knitted component 130 can at least partially extend through forefoot region 101, midfoot region 102, and/or heel region 103. Knitted component 130 can also extend along lateral side 104, medial side 105, over forefoot region 101, and/or around heel region 103. In addition, knitted component 130 can at least partially define an exterior surface 119 and an opposite interior surface 115 of upper 120. Interior surface 115 can define at least a portion of void 117 within upper 120, and exterior surface 119 can face in an opposite direction from the interior surface 115.

As will be discussed, knitted component 130 can provide the upper 120 with weight savings as compared with other conventional uppers. Additionally, in some embodiments, knitted component 130 can be configured with different zones having different characteristics. For example, one or more predetermined zones can have more stretch resistance than other zones. Also, knitted component 130 can provide the upper 120 with aesthetically pleasing features and textures. Still further, knitted component 130 can provide advantages in the manufacture of footwear 100. Other advantages due to the knitted component 130 will be explored in detail below.

Knitted Component Configurations

In some embodiments, knitted component 130 can include a plurality of knitted subcomponents that are independently formed to each have unitary knit construction.

Once formed, these knitted components of unitary knit construction can be joined together to define at least a portion of upper 120.

Figure 4:
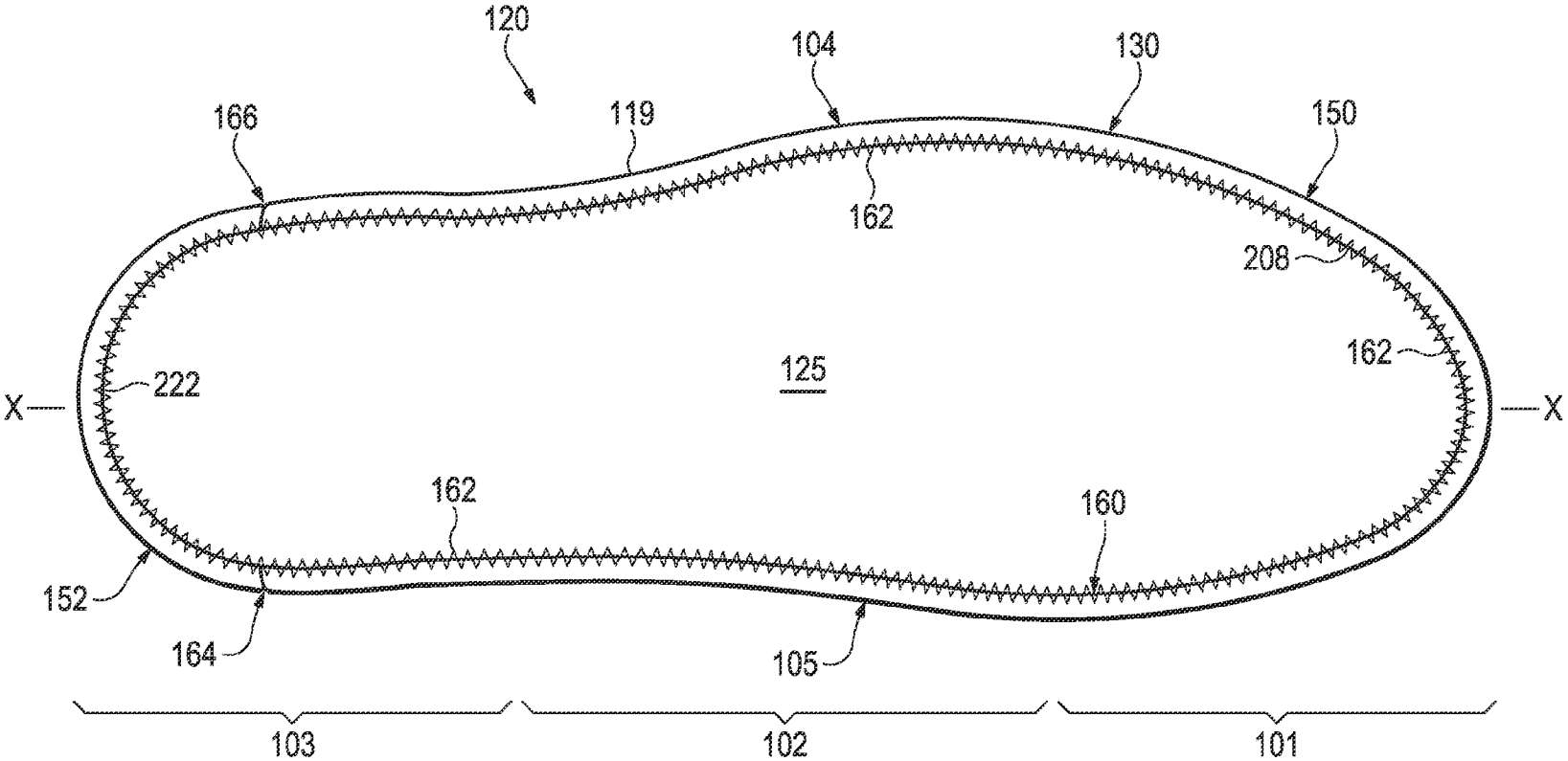
FIG. 4 is a bottom view of an upper of the article of footwear of FIG. 1.
Figure 5:
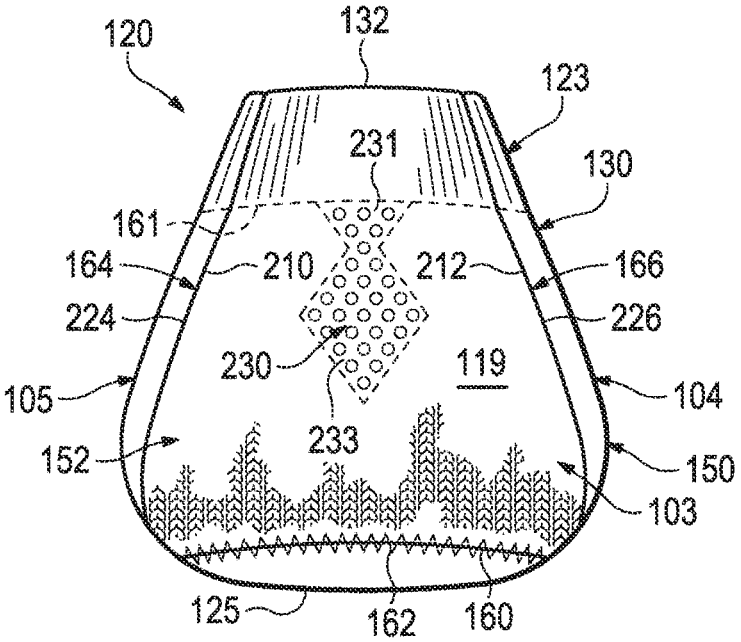
FIG. 5 is a rear view of the upper of the article of footwear of FIG. 1.

For example, as shown in the illustrated embodiments, knitted component 130 can include a first knitted component or forward knitted component 150 and a second knitted component or heel knitted component 152 that are joined together to cooperatively define knitted component 130. In one embodiment, forward knitted component 150, heel knitted component 152, and strobel 125 can be joined together to cooperatively define upper 120 as shown in FIG. 4.

Figure 6:
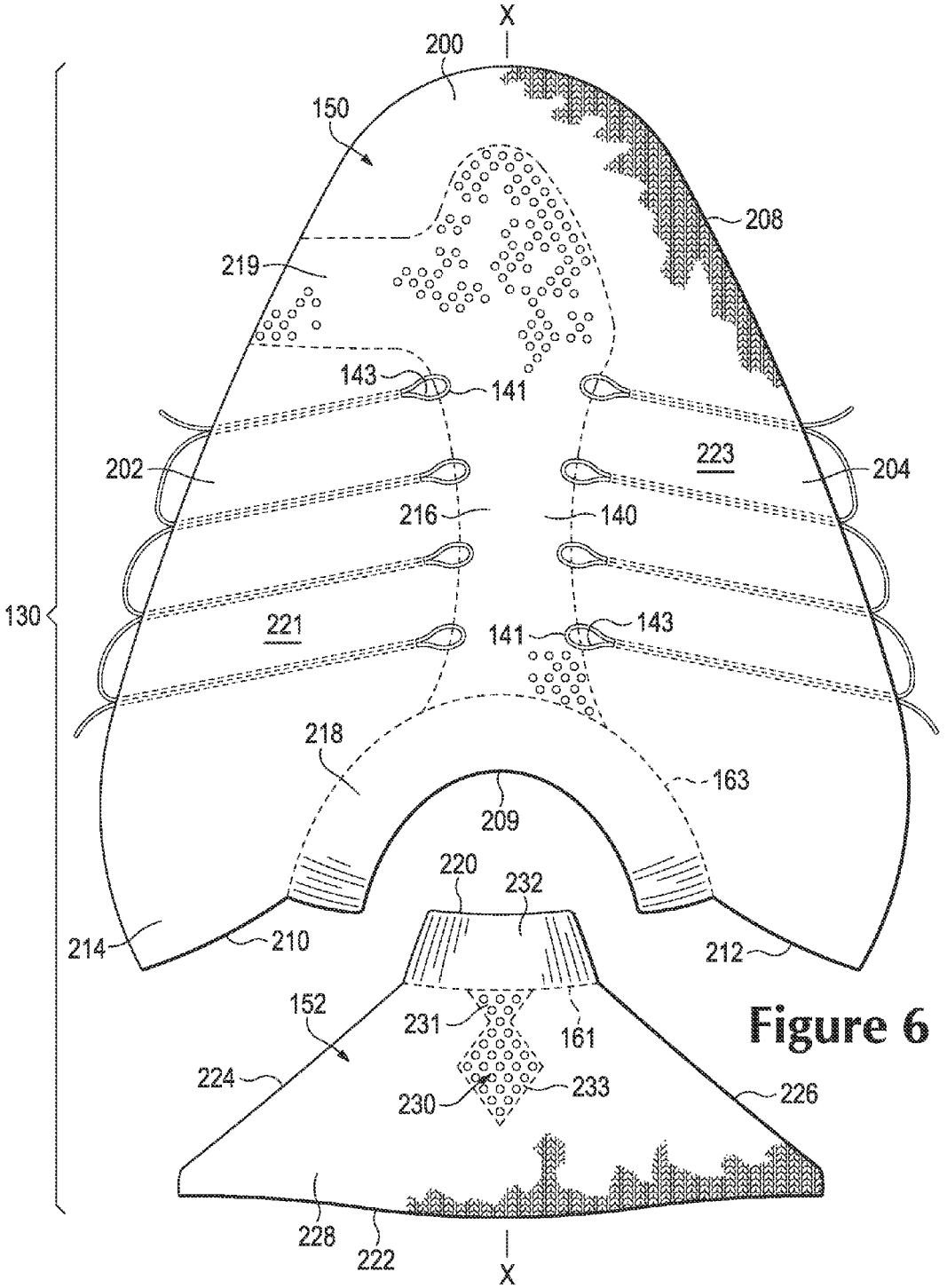
FIG. 6 is a plan view of knitted components of the upper of the article of footwear of FIG. 1.

For purposes of clarity, forward knitted component 150 and heel knitted component 152 are shown separated and laid substantially flat in FIG. 6 according to exemplary embodiments. As shown, forward knitted component 150 is formed of unitary knit construction, and heel knitted component 152 is also formed of unitary knit construction.

As used herein, the term "unitary knit construction" means that the respective component is formed as a one-piece element through a knitting process. That is, the knitting process substantially forms the various features and structures of unitary knit construction without the need for significant additional manufacturing steps or processes. A unitary knit construction may be used to form a knitted component having structures or elements that include one or more courses of yarn or other knit material that are joined such that the structures or elements include at least one course in common (i.e., sharing a common yarn) and/or include courses that are substantially continuous between each of the structures or elements. With this arrangement, a one-piece element of unitary knit construction is provided.

As shown in FIG. 6, forward knitted component 150 can include a medial portion 202, a lateral portion 204, and a forward portion 200. Boundaries of forward knitted component 150 can be defined by a first U-shaped peripheral edge 208, a smaller second U-shaped peripheral edge 209, a first rear edge 210 that extends transversely between edge 208 and edge 209, and a second rear edge 212 that extends transversely between edge 208 and edge 209.

Additionally, heel knitted component 152 can include an upper peripheral edge 220, a lower peripheral edge 222, a first side edge 224 that extends transversely between upper peripheral edge 220 and lower peripheral edge 222, and a second side edge 226 that extends transversely between upper peripheral edge 220 and lower peripheral edge 222. In some embodiments, edges 224, 226 may be at least partially angled away from each other as edges 224, 226 extend from upper peripheral edge 220 to lower peripheral edge 222.

Forward knitted component 150 can be coupled to heel knitted component 152 to define upper 120 as shown in FIGS. 1-4. For example, first rear edge 210 of forward knitted component 150 can be coupled to first side edge 224 of heel knitted component 152 to define a first seam 240 of upper 120. Also, second rear edge 212 of forward knitted component 150 can be coupled to second side edge 226 of heel knitted component 152 to define a second seam 242 of upper 120.

Forward knitted component 150 can be coupled to heel knitted component 152 along seam 240 and seam 242 in any suitable fashion. For example, knitted components 150, 152 can be coupled at seam 240 and seam 242 via stitching, via adhesives, via fasteners, or via any other suitable attachment mechanism.

When assembled into upper 120, medial portion 202 of forward knitted component 150 can define a majority of medial side 105 of upper 120. Also, forward portion 200 can define a majority of forefoot region 101 of upper 120. Additionally, lateral portion 204 can define a majority of lateral side 104 of upper 120. Heel knitted component 152 can define a majority of heel region 103 of upper 120. Also, second peripheral edge 209 and upper peripheral edge 220 can cooperate to define upper edge 132 of upper 120 as shown in FIGS. 1-3. Furthermore, first peripheral edge 208 and lower peripheral edge 222 can cooperate to define lower edge 160 of upper 120 as shown in FIG. 4. Moreover, first seam 240 can extend from upper edge 132 to lower edge 160 on medial side 105 of upper 120 as shown in FIGS. 2, 3, and 4. Additionally, second seam 242 can extend from upper edge 132 to lower edge 160 on lateral side 105 of upper 120 as shown in FIGS. 1, 3, and 4.

In some embodiments, forward knitted component 150 may include a plurality of zones that have one or more different physical properties. Boundaries of these zones are indicated by broken lines in the illustrated embodiments. For example, as most clearly illustrated in FIGS. 3 and 6, forward knitted component 150 can include a first zone 214, a second zone 216, and a third zone 218. As shown in the illustrated embodiments, third zone 218 can be U-shaped and substantially centered between medial portion 202 and lateral portion 204, adjacent second peripheral edge 209. Accordingly, an internal boundary 163 of third zone 218 can be located approximately a uniform distance spaced apart from second peripheral edge 209 so as to be substantially concentric with second peripheral edge 209 as shown in the plan view of FIG. 6. Also, second zone 216 can extend forward longitudinally from third zone 218 toward forward portion 200, and second zone 216 can include a medial branch 219 that extends between forward portion 200 and medial portion 202. A first portion 221 of first zone 214 extends between third zone 218, first rear edge 210, peripheral edge 208, and second zone 216. A second portion 223 of first zone 214 extends between third zone 218, second rear edge 212, peripheral edge 208, and second zone 216.

First zone 214, second zone 216, and third zone 218 can have one or more different physical properties. For example, first zone 214 can have a larger degree or a larger amount of stretch resistance than second zone 216, and second zone 216 can have a larger degree or larger amount of stretch resistance than third zone 218. Stated differently, first zone 214 can be stiffer than second zone 216, and second zone 216 can be stiffer than third zone 218. Thus, third zone 218 can stretch readily to allow passage of the wearer's foot through collar 123 of upper 120, whereas first zone 214 can be more stretch resistant such that first zone 214 provides support for the wearer's foot. Moreover, second zone 216 can be stretchable enough to allow upper 120 to comfortably conform to the wearer's foot.

Likewise, in some embodiments, heel knitted component 152 can include a plurality of zones that have one or more different physical properties. Boundaries of these zones are indicated by broken lines in the illustrated embodiments. For example, as most clearly illustrated in FIG. 6, heel knitted component 152 can include a first zone 228, a second zone 230, and a third zone 232.

In an exemplary embodiment, one or more of the different zones 228, 230, 232 may be associated with different portions of heel knitted component 152. By providing different portions of heel knitted component 152 with zones of varying physical properties, the fit, comfort, and/or support provided by heel knitted component to upper 120 may be varied as desired.

In one embodiment, third zone 232 may be provided along a peripheral edge of knitted component 152 that is associated with collar 132 and adjacent to opening 121 of upper 120. An internal boundary 161 of third zone 232 is shown in FIG. 6 in broken lines and partially demarcates third zone 232 from first zone 228 and partially demarcates third zone 232 from second zone 230. As shown in FIG. 6, third zone 232 can have a substantially constant width and can extend along upper peripheral edge 220. Thus, internal boundary 161 of third zone 232 can be located approximately a uniform distance spaced apart from upper peripheral edge 220 so as to be substantially concentric with upper peripheral edge 220 as shown in the plan view of FIG. 6.

In an exemplary embodiment, second zone 230 may be provided in a location along a portion of knitted component 152 that corresponds to a heel and/or Achilles tendon of a foot of a wearer. In this embodiment, second zone 230 may be located approximately in the middle of knitted component 152 along the transverse direction. By providing second zone 230 with a configuration that imparts various physical properties, the portion of knitted component 152 that corresponds to the heel and/or Achilles tendon of a foot of a wearer may have a desired fit, comfort, and/or support.

In different embodiments, second zone 230 may have any suitable shape. In one embodiment, second zone 230 may have a substantially symmetric geometric shape. For example, in this embodiment, second zone 230 can be polygonal. As shown in FIG. 6, second zone 230 can include an inverted triangular portion 231 and a diamond portion 233 that are arranged end-to-end and that extend from third zone 232 toward lower peripheral edge 222. Second zone 230 can also be substantially symmetrical and centered with respect to axis X of upper 120. Moreover, first zone 228 can extend between third zone 232, first side edge 224, lower peripheral edge 222, second side edge 226, and second zone 230.

First zone 228, second zone 230, and third zone 232 can have one or more different physical properties. For example, first zone 228 can have a larger degree or larger amount of stretch resistance than second zone 230, and second zone 230 can have a larger degree or larger amount of stretch resistance than third zone 232. Stated differently, first zone 228 can be stiffer than second zone 230, and second zone 230 can be stiffer than third zone 232.

In some embodiments, first zone 228 of heel knitted component 152 can have similar physical properties as first zone 214 of forward knitted component 150. Also, second zone 230 of heel knitted component 152 can have similar physical properties as second zone 216 of forward knitted component 150. Moreover, third zone 232 of heel knitted component 152 can have similar physical properties as third zone 218 of forward knitted component 150. Thus, for example, first zones 228, 214 can have substantially the same stretch resistance or stiffness, second zones 230, 216 can have substantially the same stretch resistance or stiffness, and third zones 232, 218 can have substantially the same stretch resistance or stiffness.

The varying stretch resistance of each zone 214, 216, 218, 228, 230, 232 can be achieved in various ways. For example, in some cases, each zone 214, 216, 218, 228, 230, 232 can have a different stitching pattern. Additionally, each zone 214, 216, 218, 228, 230, 232 may include different types of yarns or strands. More specifically, in one embodiment, third zones 218, 232 can be formed using a half-gauge knit to provide a ribbed appearance, and third zones 218, 232 can be formed at least partially using one or more elastic yarns, such as spandex. Second zones 216, 230 can be formed using a full-gauge knit and can be formed using one or more elastic yarns, such as spandex. In additional embodiments, second zones 216, 230 can have a mesh-type of appearance for increased breathability. Furthermore, first zones 214, 228 can be formed using a full-gauge knit and can include yarns made from thermoplastic polymeric material. These yarns can be less elastic than yarns included in second and third zones 216, 230, 218, 232, and these yarns can partially melt and fuse to impart additional stiffness to the respective zones 214, 228 after heat is applied to upper 120. It will be appreciated that these thermoplastic yarns can be absent from second and third zones 216, 230, 218, 232. It will also be appreciated that the yarns of each zone 214, 216, 218, 228, 230, 232 can be incorporated and controlled through known intarsia knitting processes. Moreover, the zones 214, 216, 218, 228, 230, 232 can be formed and incorporated according to the teachings in commonly-owned U.S. patent application Ser. No. 13/691,316 to Podhajny, et al., entitled "Article of Footwear Incorporating a Knitted Component," filed Nov. 30, 2012, which is hereby incorporated by reference in its entirety.

It will be appreciated that the knitted component 130 of upper 120 can provide weight savings for the article of footwear 100. Also, the knitted component 130 can provide different physical characteristics at different zones 214, 216, 218, 228, 230, 232 such that upper 120 can be comfortable, can provide localized support to the wearer's foot, and can be easy to put on and remove. Moreover, the knitting processes used to produce knitted component 130 can reduce waste, can reduce manufacturing time, and/or can provide other manufacturing advantages.

Also, as discussed above, knitted component 130 can be formed from a plurality of subcomponents, namely, forward knitted component 150 and heel knitted component 152. As such, properties of knitted component 130 can be highly controlled during manufacture. For example, it will be appreciated that the heel region 103 of upper 120 can be important for providing support to the wearer's heel without sliding or rubbing uncomfortably on the wearer's skin. Thus, heel knitted component 152 can include relatively stiff first zone 228 for providing suitable support. Heel knitted component 152 can also include the more elastic second zone 230, which can be substantially centered on heel knitted component 152, such that the second zone 230 can stretch and conform comfortably against the wearer's heel. The second zone 230 can also stretch and conform as the wearer's heel flexes during walking, running, and otherwise moves. Thus, the heel knitted component 152 can provide an important balance of stiff support and flexure such that a separate heel counter may not be necessary in the article of footwear 100.

Moreover, because the forward knitted component 150 and heel knitted component 152 are separate and independent and are each of unitary knit construction, portions of upper 120 can be tailored and tuned for particular uses, for particular wearers, or for other purposes. For example, if the heel region 103 of upper 120 is to have a different desired physical property, for example to be made stiffer, then forward knitted component 150 could be joined to a different heel knitted component provided with a smaller second zone than second zone 230. Alternatively, if heel region 103 is to be made more flexible, then forward knitted component 150 could be joined to another different heel knitted component provided with a larger second zone than second zone 230.

Manufacturing of knitted components 150, 152 and upper 120 will now be discussed. As mentioned, knitted components 150, 152 can be formed to have one-piece unitary knit construction. For example, knitted components 150, 152 can be knit on flat knitting machines. Also, in some embodiments, heel knitted component 152 can be knit such that upper peripheral edge 220 is formed first, and additional courses can be added until lower peripheral edge 222 is formed. As such, upper peripheral edge 220 can have a neat and finished appearance, and raw lower peripheral edge 222 can be eventually covered and bound by sole structure 110. Likewise, forward knitted component 150 can be formed such that second peripheral edge 209 is formed first, and courses can be added until first peripheral edge 208 is formed.

Figure 7:
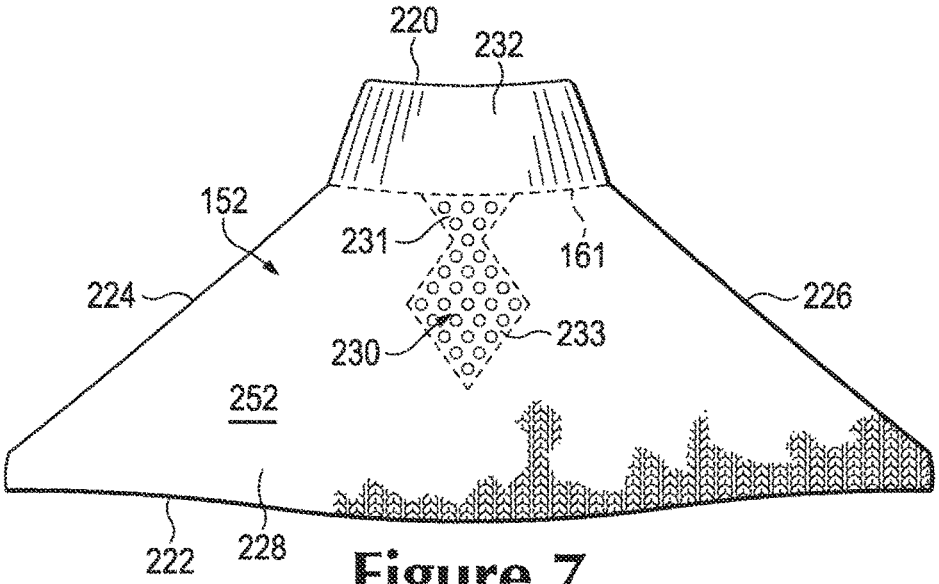
FIG. 7 is a plan view of an exterior surface of a heel knitted component of the upper of the article of footwear of FIG. 1.

Then, knitted components 150, 152 can be joined at seams 240, 242 as discussed above. To facilitate this assembly process, heel knitted component 152 can include an indicia 254, such as an "X" shown in FIG. 8, which differentiates between an interior surface 250 of heel knitted component 152 and an exterior surface 252 of heel knitted component 152. It is noted that exterior surface 252 of heel knitted component 152, shown in FIG. 7, does not include indicia 254. Thus, even if heel knitted component 152 is substantially symmetric, the manufacturer can differentiate between interior and exterior surfaces 250, 252 to assist with orienting heel knitted component 152 for attachment to forward knitted component 150.

Figure 8:
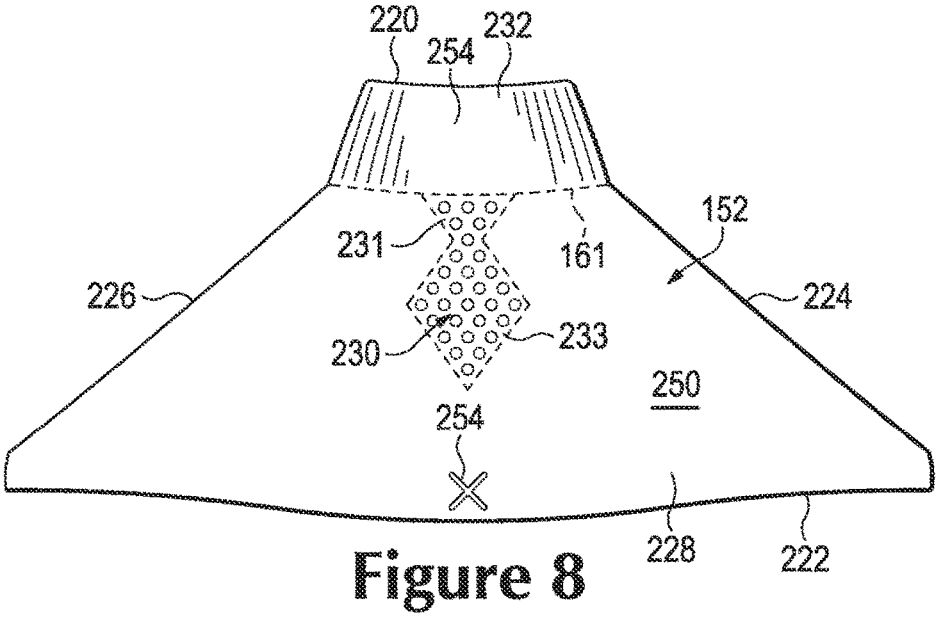
FIG. 8 is a plan view of an interior surface of a heel knitted component of the upper of the article of footwear of FIG. 1.

It is also noted that interior surface 250 can partially define void 117 of upper 120, and exterior surface 252 can face outwardly. Thus, indicia 254 as shown in FIG. 8 can be less visible to the wearer or others when upper 120 is fully assembled. However, it will be appreciated that exterior surface 252 can include indicia 254 instead of interior surface 250. Also, indicia 254 can be formed by yarns or strands included in the unitary knit construction of heel knitted component 152, or indicia 254 can be marked separately from unitary knit construction of heel knitted component 152. Moreover, indicia 254 can be located in any suitable location of heel knitted component 152. For example, as shown in FIG. 8, indicia 254 can be substantially centered on heel knitted component 15 and may be adjacent to lower peripheral edge 222.

Once knitted components 150, 152 are joined at seams 240, 242, strobel 125 can be attached to lower edge 160 as shown in FIG. 4. Then, sole assembly 110 can be attached as discussed above.

Figure 9:
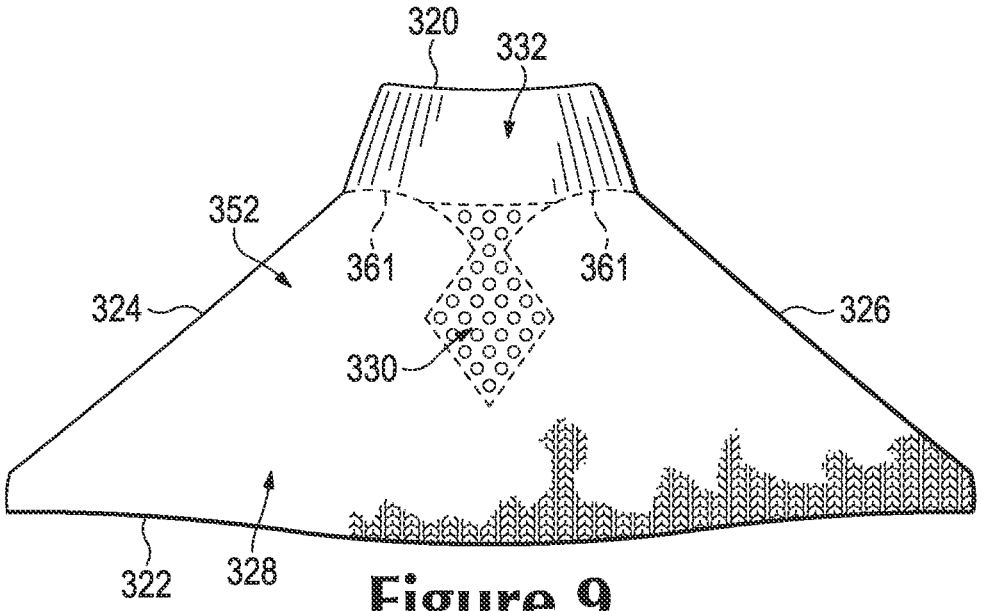
FIG. 9 is a plan view of a heel knitted component according to additional embodiments of the present disclosure.

Referring now to FIG. 9, an alternate embodiment of a heel knitted component 352 is illustrated according to additional teachings of the present disclosure. Heel knitted component 352 can be substantially similar to the embodiments discussed above. For example, heel knitted component 352 can include a first zone 328, a second zone 330, and a third zone 332 similar to the embodiments discussed above. However, heel knitted component 352 can define an internal boundary 361 demarcating third zone 332 from first zone 328 and second zone 330 that differs from the embodiments of FIG. 7. More specifically, while internal boundary 161 is located approximately a uniform distance from upper peripheral edge 220 in the embodiments of FIGS. 6-8, curvature of boundary 361 can be inverted relative to upper peripheral edge 320 such that portions of internal boundary 361 may be spaced apart from upper peripheral edge 320 by varying distances. For example, portions of internal boundary 361 disposed closer to second zone 330 may be spaced apart from upper peripheral edge 320 by a larger distance than other portions. Thus, the width of third zone 332 between upper peripheral edge 320 and internal boundary 361 can vary across third zone 332 in the plan view of FIG. 9. This can allow heel knitted component 352 to conform closely to the wearer's heel for added comfort and support.

In summary, footwear 100 can provide several advantages. Footwear 100 can be comfortable to wear. Footwear 100 can provide support to the wearer's foot. Footwear 100 can also flex with the wearer's foot and can flexibly conform to the wearer's foot. Physical properties can vary across different regions of footwear 100 to further enhance performance.

Knitted Components with Gores

Various knit structures, including gores, may be incorporated into forward knitted component 150, heel knitted component 152, or other knitted components to impart a contoured (e.g., rounded, non-planar, or otherwise three-dimensional) configuration. In addition to shaping or contouring the knitted components during the knitting process that forms the knitted components, a gore may provide advantages of enhancing the comfort of footwear 100 and increasing the overall manufacturing efficiency of footwear 100.

Figure 10:
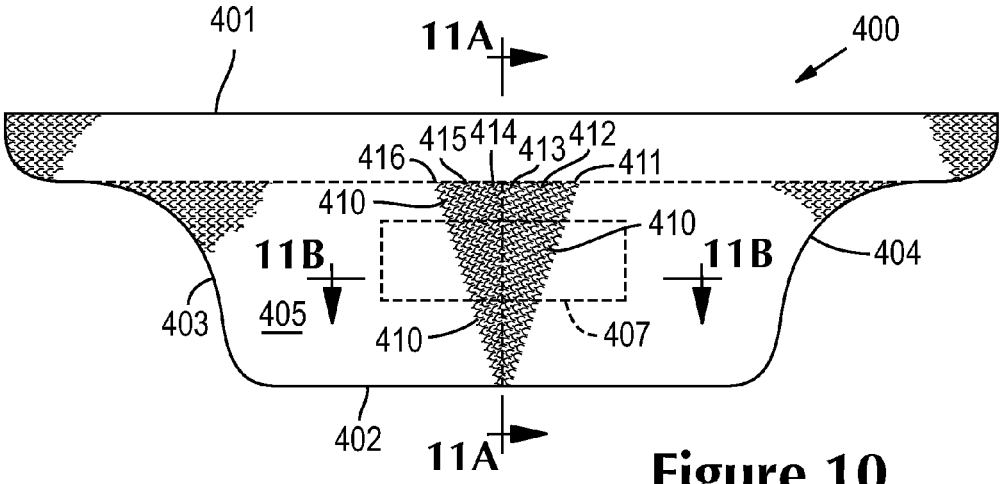
FIG. 10 is a plan view of a heel knitted component according to additional embodiments of the present disclosure.
Figure 11B:
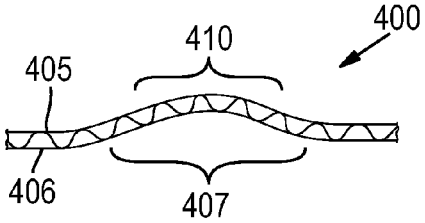
FIGS. 11A and 11B are cross-sectional views of the heel knitted component illustrated in FIG. 10, as respectively defined along section lines 11A-11A and 11B-11B in FIG. 10.
Figure 11A:
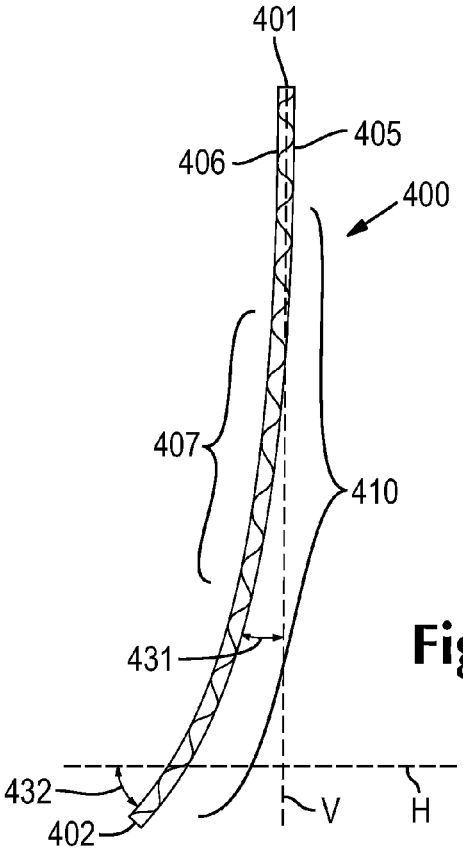

An example of a heel knitted component 400 that includes a gore is depicted in FIGS. 10, 11A and 11B. Heel knitted component 400 has an upper peripheral edge 401, a lower peripheral edge 402, a first side edge 403 that extends between upper peripheral edge 401 and lower peripheral edge 402, and a second side edge 404 that extends between upper peripheral edge 401 and lower peripheral edge 402. Heel knitted component 400 defines an exterior surface 405 and an opposite interior surface 406.

The knit structure of heel knitted component 400 incorporates a gore region 410, which includes a gore that imparts a contoured configuration, as depicted in FIGS. 11A and 11B. Gore region 410 is formed of unitary knit construction with a remainder of heel knitted component 400. In addition, gore region 410 has a generally triangular shape that is centrally-located in heel knitted component 400 and extends through a majority (i.e., at least 50 percent) of a distance between peripheral edges 401 and 402, but may be smaller or larger in further configurations of heel knitted component 400. In this location, the portion of heel knitted component 400 that includes gore region 410 corresponds with the location of the heel and achilles tendon of the wearer. Gore region 410 provides a rounded aspect to heel knitted component 400, which may enhance the comfort of footwear 100 and increase the overall manufacturing efficiency of footwear 100.

Gore region 410 is at least partially located in a central area 407 of heel knitted component 400, which is centrally-located or spaced inwards from edges 401-404 and includes a center of heel knitted component 400. Gore region 410 is depicted as having a generally triangular shape that arises from knitting a series of courses of decreasing length, and then knitting a series of courses of increasing length to insert a gore into heel knitted component 400. Referring to FIG. 10, a pair of courses 411 and 416 in gore region 410 have a relatively long length, a pair of courses 412 and 415 in gore region 410 have a lesser length than courses 411 and 416, and a pair of courses 413 and 414 in gore region 410 have a lesser length than each of courses 411, 412, 415, 416. As such, the generally triangular shape of gore region 410 is formed by knitting courses of varying length in central area 407. Note that courses 411-416 are selected for purposes of example and gore region 410 may have numerous other courses, some of which are located between or otherwise separate courses 411-416. Additional details regarding the process for forming gore region 410 will be discussed in greater detail below.

The configuration of gore region 410, as discussed above and depicted in the figures, provides one example that is suitable for footwear 100. In other configurations of heel knitted component 400, gore region 410 may have a variety of other shapes, including diamond, square, rectangular, elliptical, round, or irregular, depending upon the specific knitting method utilized to form gore region 410. In further configurations, the size or location of gore region 410 may vary considerably to provide specific features (e.g., three-dimensional regions) to heel knitted component 400 or other areas of heel knitted component 400. The orientation of gore region 410 may also vary. A structure that is similar to gore region 410 may also be incorporated into forward knitted component 150 to impart a three-dimensional region.

Figure 12:
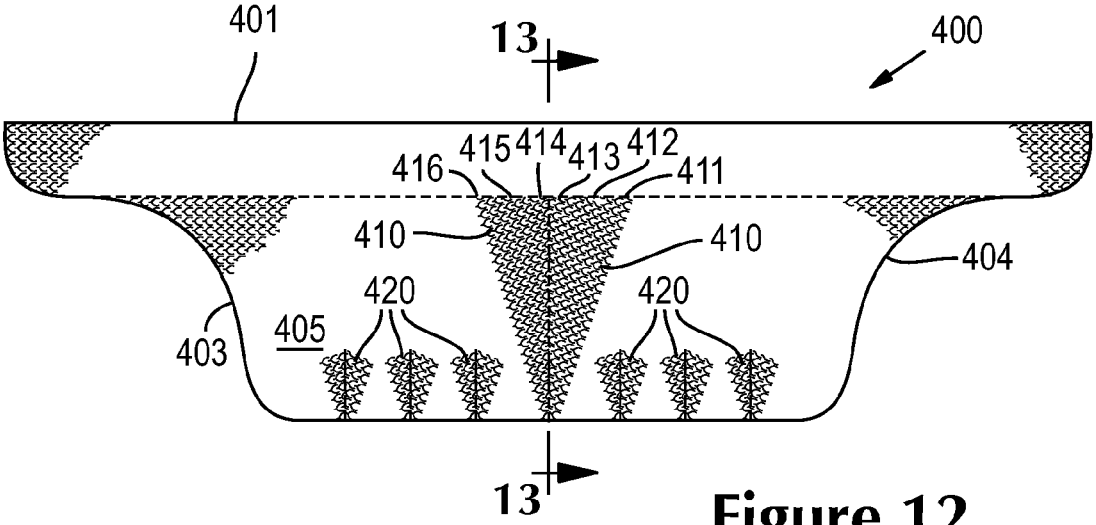
FIG. 12 is a plan view of a heel knitted component according to additional embodiments of the present disclosure.
Figure 13:
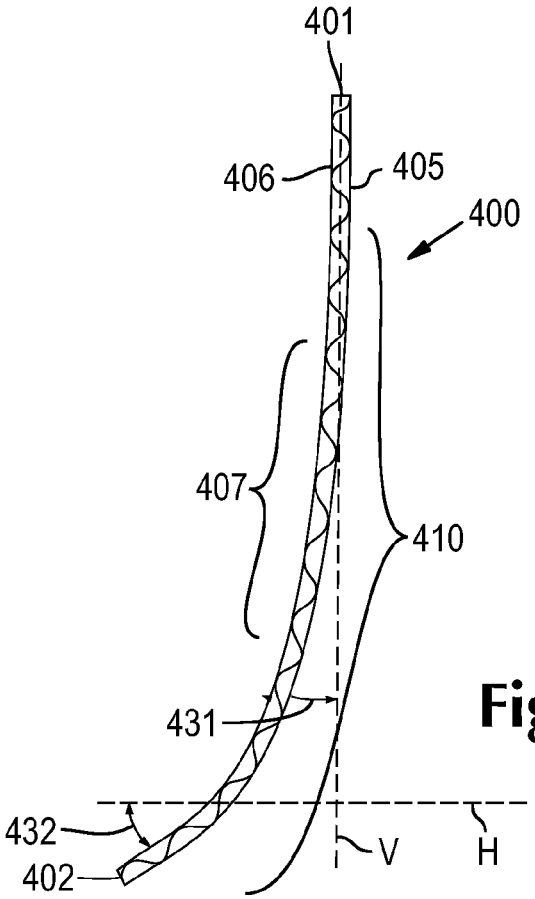
FIG. 13 is a cross-sectional view of the heel knitted component illustrated in FIG. 12, as defined along section line 13-13 in FIG. 12.

Another configuration of heel knitted component 400 is depicted in FIGS. 12 and 13 as including a plurality of peripheral gore regions 420 that are distributed along or adjacent to lower peripheral edge 402 and on opposite sides of gore region 410. That is, a first portion of peripheral gore regions 420 are located on one side of the gore region 410, and a second portion of peripheral gore regions 420 are located on an opposite side of gore region 410. Peripheral gore regions 420 form a series of gores along a common edge (i.e., lower peripheral edge 402) of heel knitted component 400.

In comparison with gore region 410, peripheral gore regions 420 are relatively small and may extend through less than one-third of the distance between peripheral edges 401 and 402, but may also extend through a lesser distance, including less than 20 percent, 15 percent, or 10 percent of the distance between peripheral edges 401 and 402. In some configurations, gore region 410 may be at least two times, at least three times, or more than four times the area of each of peripheral gore regions 420. An advantage of incorporating peripheral gore regions 420 into heel knitted component 400 relates to the rounded, non-planar, or otherwise three-dimensional configuration. More particularly, peripheral gore regions 420 may impart greater curvature to heel knitted component 400 than gore region 410 alone, as depicted through a comparison of FIGS. 11A and 13. Moreover, the combination of gore region 410 and each of peripheral gore regions 420 may further impart a contoured configuration to the area of heel knitted component 400 that is adjacent to lower peripheral edge 420. As with gore region 410, peripheral gore regions 420 may be formed by knitting a series of courses of decreasing length, and then knitting a series of courses of increasing length to insert gores into heel knitted component 400.

A vertical axis V and horizontal axis H are superimposed over heel knitted component 400 in FIGS. 11A and 13. An angle 431 represents the deflection of heel knitted component 400 from vertical axis V. Similarly, an angle 432 represents the deflection of heel knitted component 400 from horizontal axis H. In the absence of gore region 410, angle 431 would be substantially zero in each of FIGS. 11A and 13. Given that gore region 410 imparts contouring or curvature, however, heel knitted component 400 deflects away from vertical axis V and angle 431 is greater than zero. In the absence of peripheral gore regions 420, angle 432 would be substantially similar in FIGS. 11A and 13. Given that peripheral gore regions 420 imparts contouring or curvature, however, angle 432 is less in FIG. 13 than in FIG. 11A. That is, the curvature in heel knitted component 400 due to peripheral gore regions 420 causes portions of heel knitted component 400 that are adjacent to lower peripheral edge 402 to approach horizontal axis H.

Gore regions 410 and peripheral gore regions 420 each assist in imparting the contoured configuration to heel knitted component 400. Given that gore region 410 extends through a majority of a distance between peripheral edges 401 and 402, gore region 410 may be primarily responsible for imparting the overall rounded shape to heel knitted component 410, as depicted in FIGS. 11A and 11B. Given that peripheral gore regions 420 are located along lower peripheral edge 402, peripheral gore regions 420 may be primarily responsible for imparting a more rounded shape to the area of heel knitted component 410 that is adjacent to lower peripheral edge 402. Accordingly, gore region 410 and peripheral gore regions 420 operate cooperatively to form the rounded, non-planar, or otherwise three-dimensional configuration to specific areas of heel knitted component 400.

Peripheral gore regions 420 effectively curve or contour the portion of heel knitted component 400 that is adjacent to lower peripheral edge 402 to facilitate attaching heel knitted component 400 to one or both of forward knitted component and an upper surface or other portions of sole structure 110. In some configurations, the contoured configuration in heel knitted component 400 forms a lip that is approximately parallel to the upper surface of sole structure 110 and may be used in place of strobel 125 to facilitate attachment of heel knitted component 400 to sole structure 110. In addition, in some configurations, lower areas of forward knitted component 150 may include gore regions that are similar to peripheral gore regions 420 to continue to extend the lip around the periphery of upper 120 and facilitate attachment of upper 120 to sole structure 110. In some cases, this structure may be used together with strobel 125 or another strobel sock, or this structure may replace the use of a strobel 125.

Figure 14A:
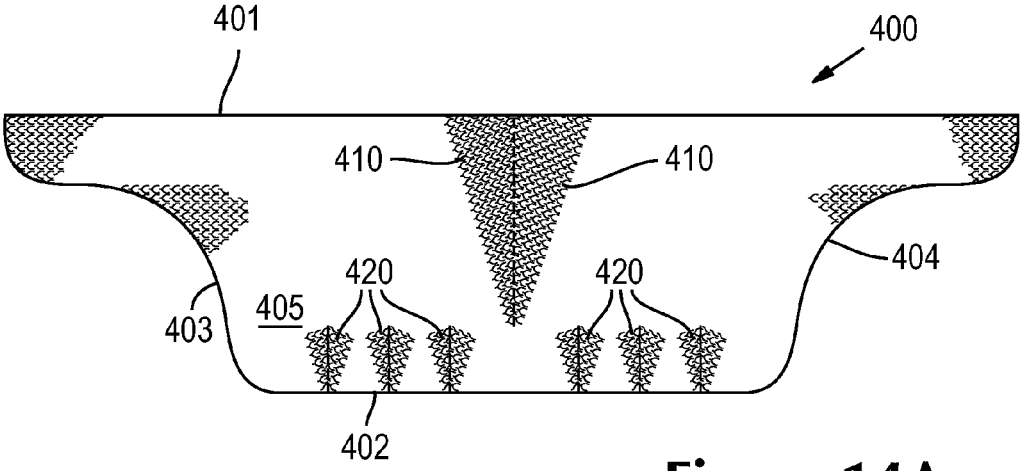
FIGS. 14A-14C are plan views of further heel knitted components according to additional embodiments of the present disclosure.
Figure 14B:
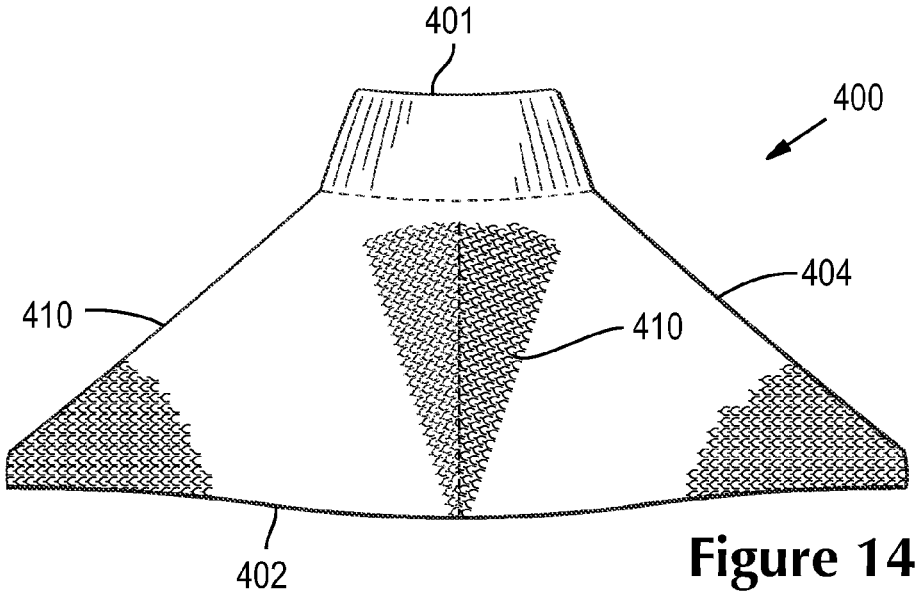
Figure 14C:
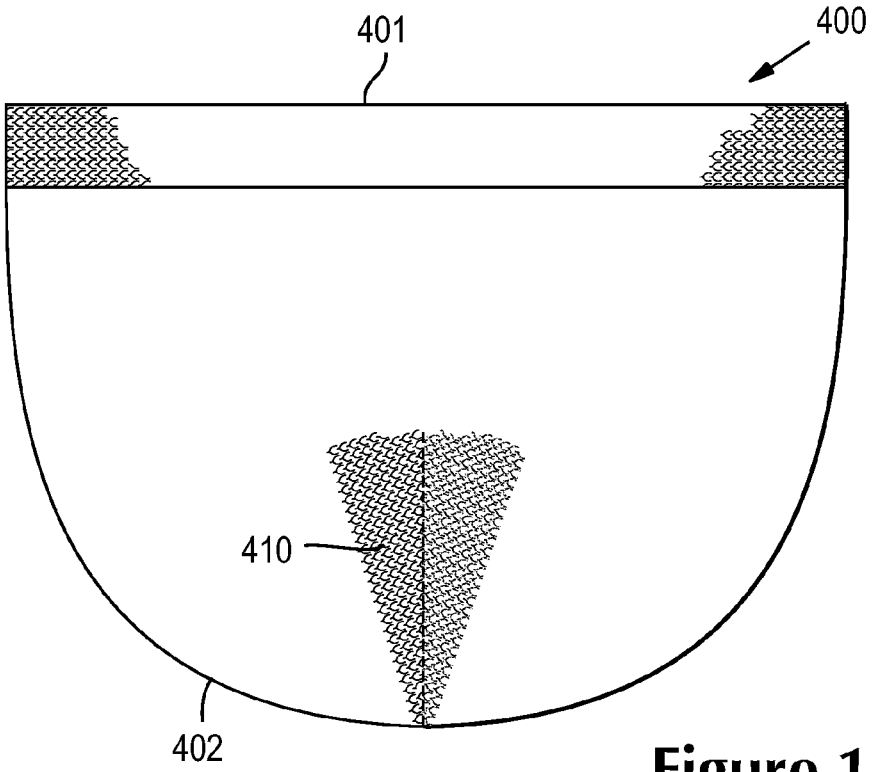

A further configuration of heel knitted component 400 is depicted in FIG. 14A, wherein gore region 410 extends inward from upper peripheral edge 401 and into an area corresponding with central area 407. Referring to FIG. 14B, heel knitted component 400 has the general shape of heel knitted component 152 and incorporates gore region 410 into this shape. Another configuration of heel knitted component 400 is depicted in FIG. 14C as having a U-shaped configuration. Accordingly, various aspects relating to location of gore region 410 and the overall shape of heel knitted component 400 may vary considerably.

Figure 15:
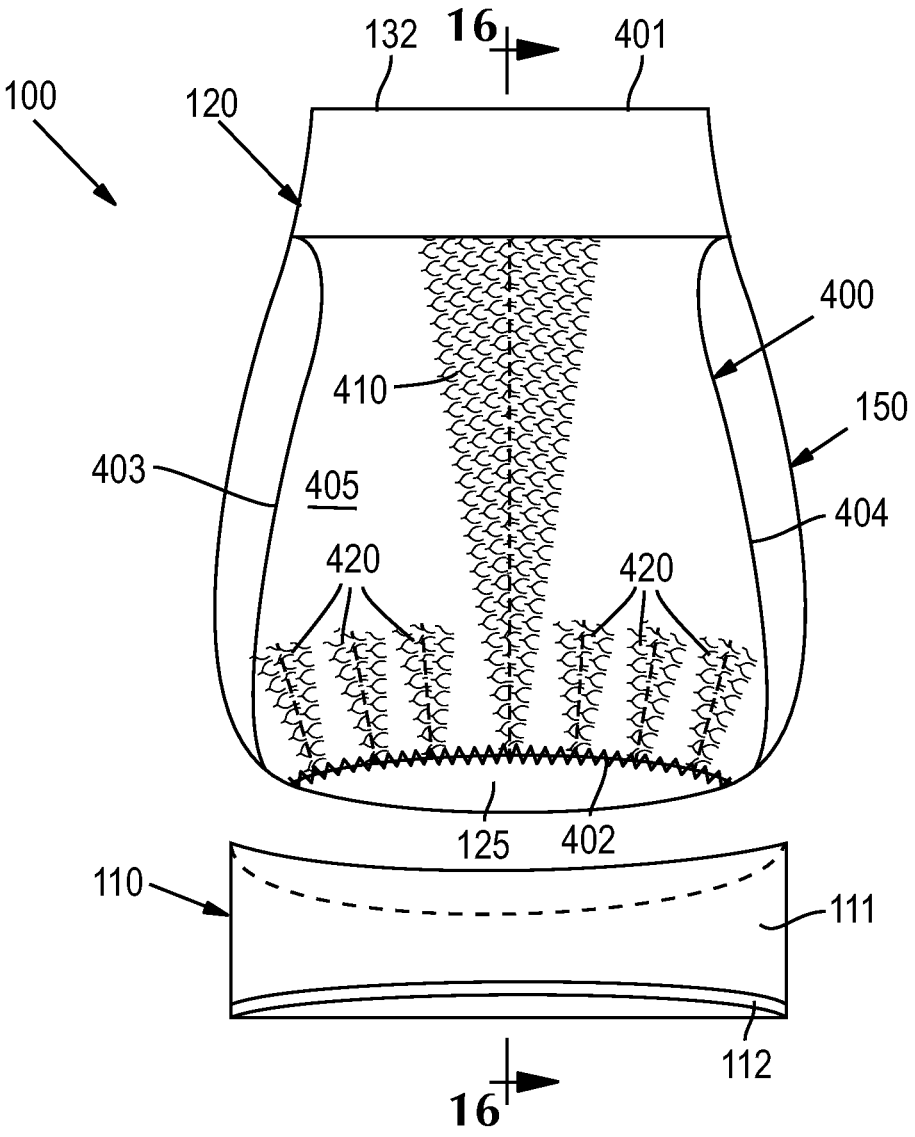
FIG. 15 is an exploded rear elevational view of the article of footwear incorporating the heel knitted component depicted in FIGS. 12 and 13.
Figure 16:
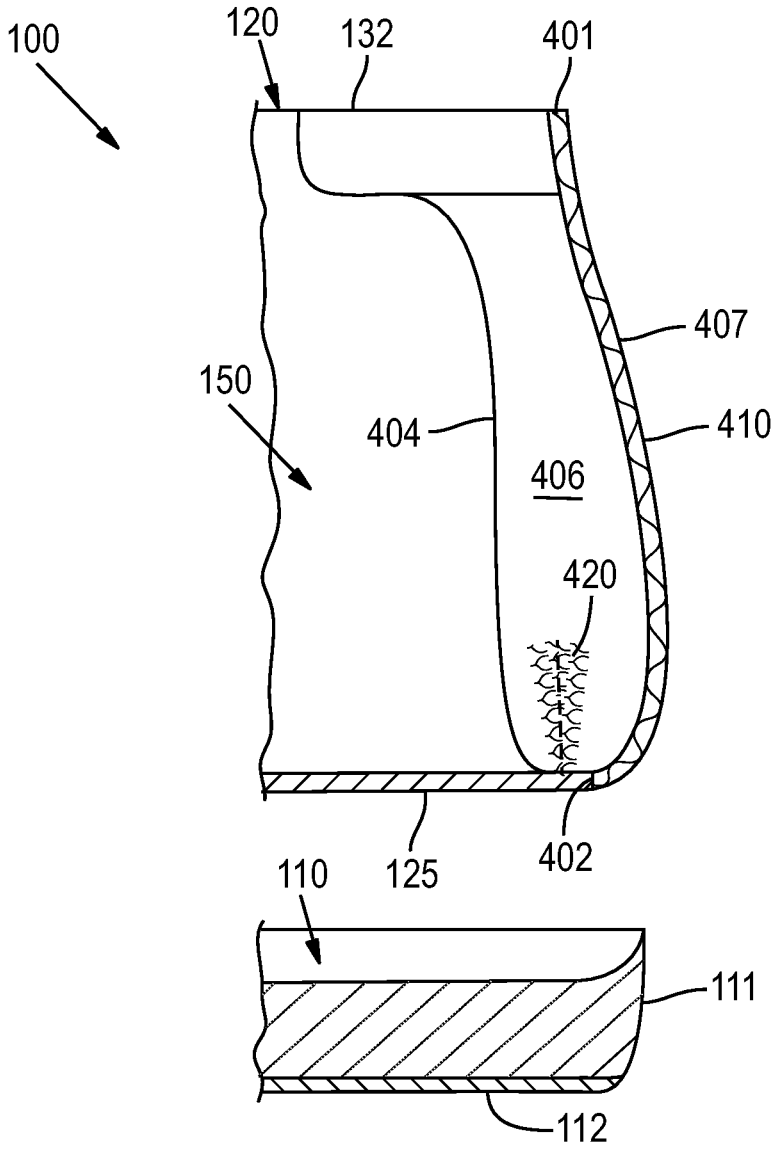
FIG. 16 is a cross sectional view of the article of footwear, as defined along section line 15-15 in FIG. 14.

The manner in which heel knitted component 400 is incorporated into footwear 100 is depicted in FIGS. 15 and 16. Although the overall shape of heel knitted component 400 varies from the shape of heel knitted component 152, heel knitted component 400 may be incorporated into footwear 100 in a similar manner. More particularly, first rear edge 210 of forward knitted component 150 can be coupled to first side edge 403 of heel knitted component 400, and second rear edge 212 of forward knitted component 150 can be coupled to second side edge 404 of heel knitted component 400. In addition, lower peripheral edge 402 may be secured to strobel 125 or an upper surface of sole structure 110. In some configurations, the shapes and locations of first rear edge 210 and second rear edge 212 of forward knitted component 150 may be modified to join with side edges 403 and 404. Although heel knitted component 400 and forward knitted component 150 are depicted as being secured to strobel 125, strobel 125 may be absent in some configurations of footwear 100.

When incorporated into footwear 100, gore region 410 extends upward in heel region 103 and through a majority of a distance between sole structure 110 and upper edge 132, which forms opening 121 (e.g., an ankle opening of upper 120). In this location, the convex configuration of interior surface 406 contacts and conforms with the heel and achilles tendon area of the wearer. Given that the rounded aspect of heel knitted component 400 may better conform with the contours of the wearer's foot than a planar knitted component, heel knitted component 400 may enhance the comfort of footwear 100. When incorporated into footwear 100, peripheral gore regions 420 are located in heel region 103 and proximal to the interface between sole structure 110 and upper 120. In this location, the rounded aspect of heel knitted component 400 adjacent to lower peripheral edge 404 conforms with the shape of an upper surface of midsole 111. Given that incorporating one or both of gore region 410 and peripheral gore regions 420 also shapes heel knitted component 400 during the knitting process, the number of shaping processes that occur prior to or during the lasting process that forms footwear 100 is decreased, thereby increasing the overall manufacturing efficiency of footwear 100.

Knitting Machine Configuration

Figure 17:
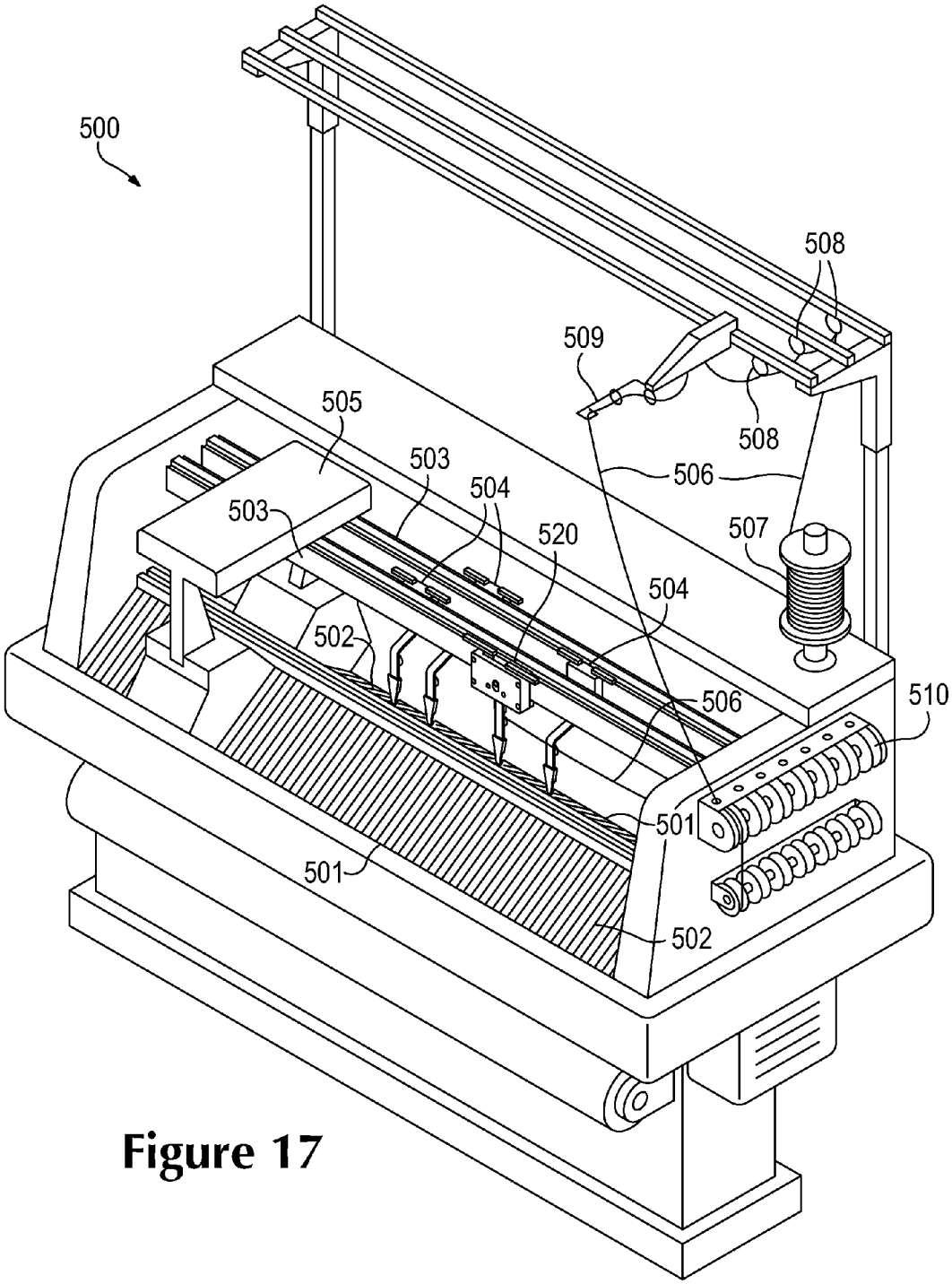
FIG. 17 is a perspective view of a knitting machine.

Although knitting may be performed by hand, the commercial manufacture of knitted components is generally performed by knitting machines. An example of a knitting machine 500 that is suitable for producing any of knitted components 150, 152, and 400 is depicted in FIG. 17. Knitting machine 500 has a configuration of a V-bed flat knitting machine for purposes of example, but knitted components 150, 152, and 400 or aspects of knitted components 150, 152, and 400 may be produced on other types of knitting machines.

Knitting machine 500 includes two needle beds 501 that are angled with respect to each other, thereby forming a V-bed. Each of needle beds 501 include a plurality of individual needles 502 that lay on a common plane. That is, needles 502 from one needle bed 501 lay on a first plane, and needles 502 from the other needle bed 501 lay on a second plane. The first plane and the second plane of the two needle beds 501 are angled relative to each other and meet to form an intersection that extends along a majority of a width of knitting machine 500. As is conventional with this form of knitting machine, needles 502 each have a first position where they are retracted and a second position where they are extended. In the first position, needles 502 are spaced from the intersection where the first plane and the second plane meet. In the second position, however, needles 502 pass through the intersection where the first plane and the second plane meet.

A pair of rails 503 extend above and parallel to the intersection of needle beds 501 and provide attachment points for multiple feeders 504. Due to the action of a carriage 505, feeders 504 move along rails 503 and needle beds 501, thereby supplying yarns to needles 502. In FIG. 17, a yarn 506 is provided to one of feeders 504 by a spool 507. More particularly, yarn 506 extends from spool 507 to various yarn guides 508, a yarn take-back spring 509, and a yarn tensioner 510 before entering feeder 504. Although not depicted, additional spools 507 may be utilized to provide yarns to other feeders 504.

Manufacturing Process

Figure 18A:
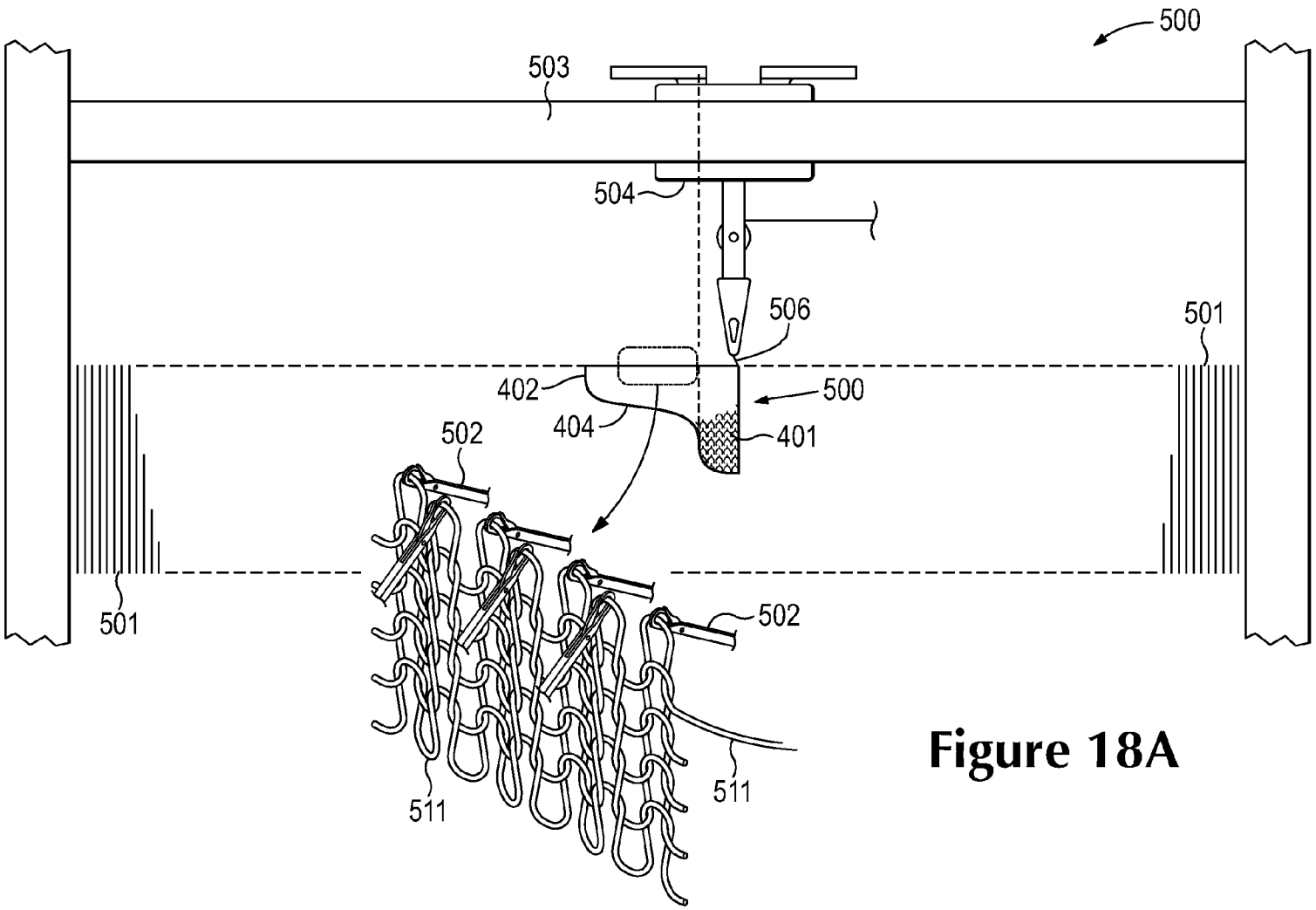
FIGS. 18A-18D are schematic elevational views of a portion of the knitting machine and depicting a knitting process for forming the heel knitted component depicted in FIGS. 10 and 11.

A manufacturing process that utilizes knitting machine 500 to form the configuration of heel knitted component 400 depicted in FIG. 10 will now be discussed. Initially, a portion of heel knitted component 400 is formed by knitting machine 500, as depicted in FIG. 18A. In forming this portion of heel knitted component 400, feeder 504 repeatedly moves along rail 503 and various courses are formed from at least yarn 506. More particularly, needles 502 pull sections of yarn 506 through loops of a prior course, thereby forming another course. It should be noted that although heel knitted component 400 is depicted as being formed from one yarn 506, additional yarns may be incorporated into heel knitted component 400 from further feeders 504.

Figure 18B:
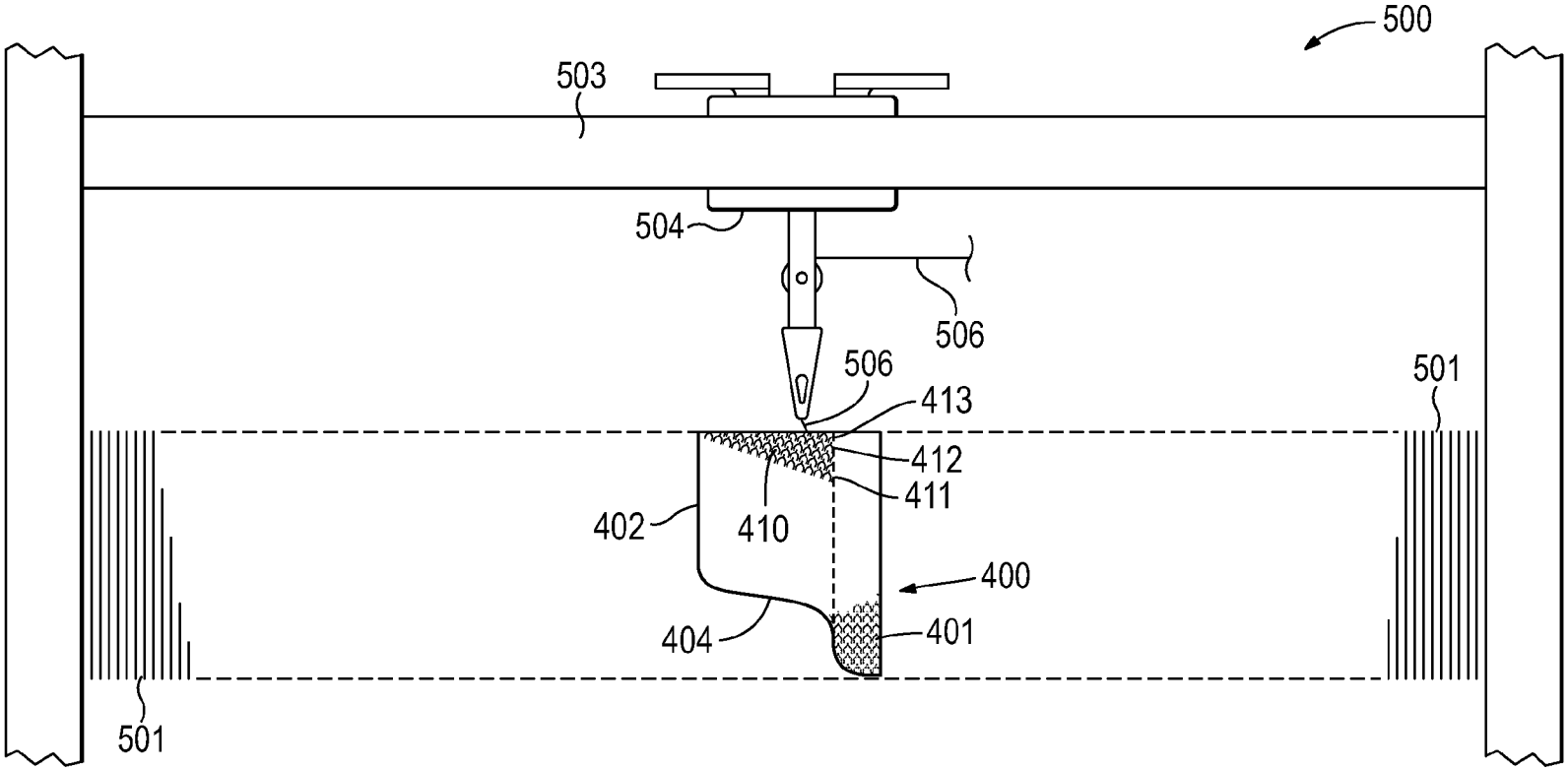

Knitting machine 500 now begins the process of forming gore region 410, as depicted in FIG. 18B, by knitting a series of courses of decreasing length. More particularly, course 411 is formed, course 412 with a lesser length is formed after course 411, and then course 413 with an even lesser length is formed after each of courses 411 and 412. As courses 411, 412, and 413 are respectively formed with decreasing length, portions of previously-formed courses may be held on needles 502.

Figure 18C:
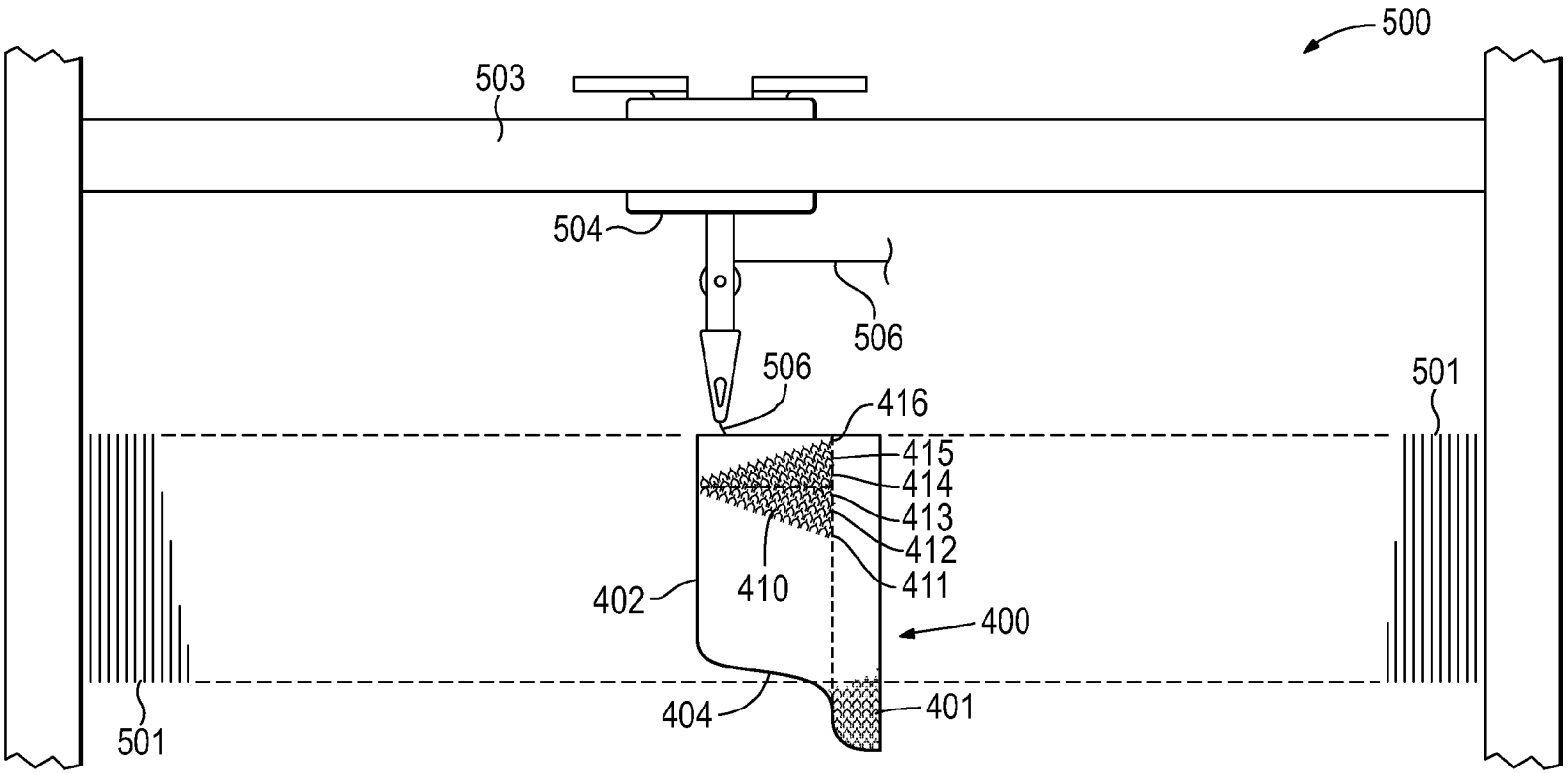

As the manufacturing process continues, as depicted in FIG. 18C, knitting machine 500 forms a remainder of gore region 410 by knitting a series of courses of increasing length. More particularly, course 414 is formed, course 415 with a greater length is formed after course 414, and then course 416 with an even greater length is formed after each of courses 414 and 415. As courses 414, 415, and 416 are respectively formed with increasing length, portions of previously-formed courses that were held on needles 502 are now joined with courses 414-416.

Figure 18D:
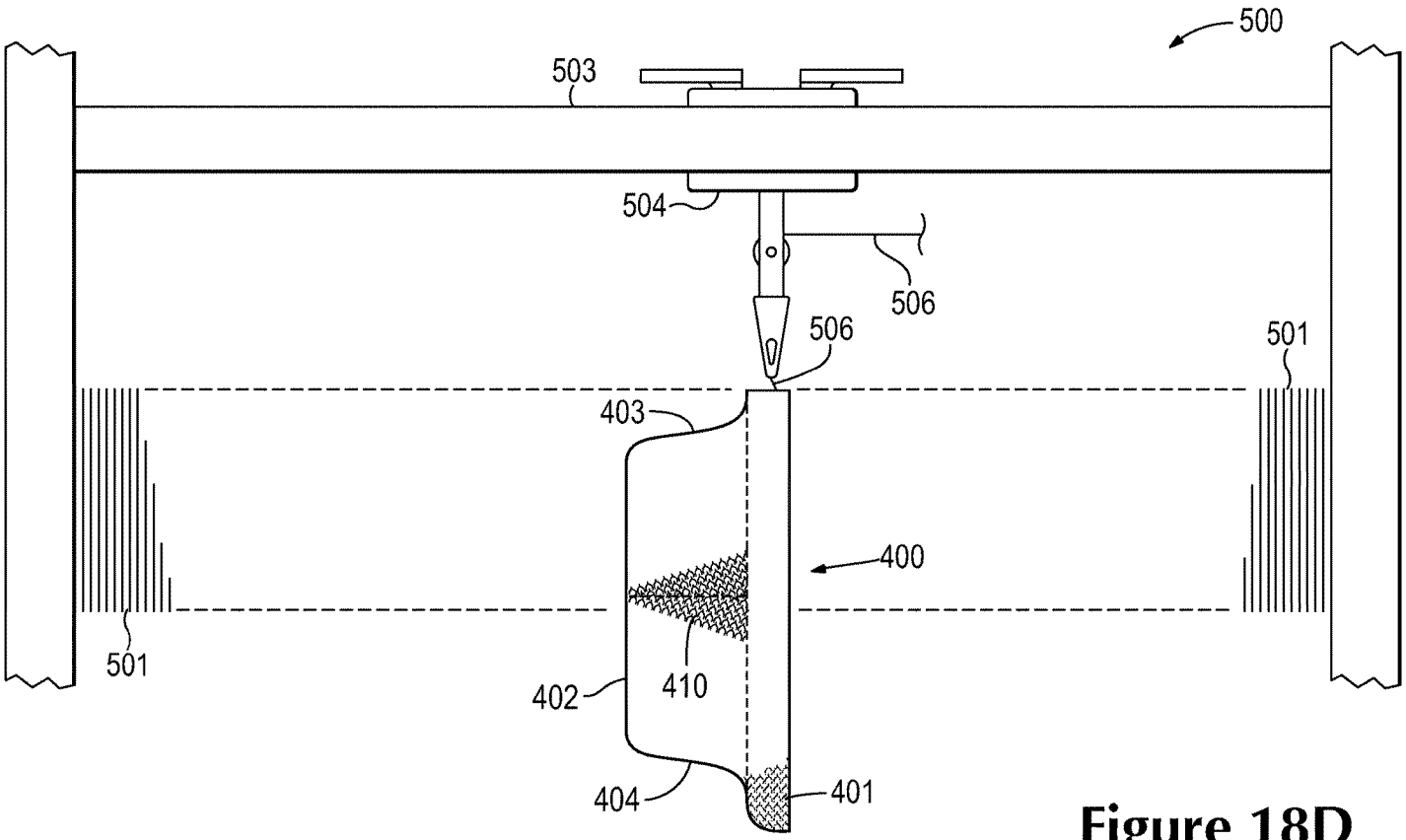

Based upon the above discussion, knitting machine 500 forms gore region 410 by knitting a first series of courses of decreasing length (e.g., courses 411-413), and then knitting a second series of courses of increasing length (e.g., courses 414-416) to insert a gore into heel knitted component 400, thereby forming gore region 410. Following the formation of gore region 410, the knitting process continues, as depicted in FIG. 18D, and a substantial portion of the remainder of heel knitted component 400 is formed.

Figure 19:
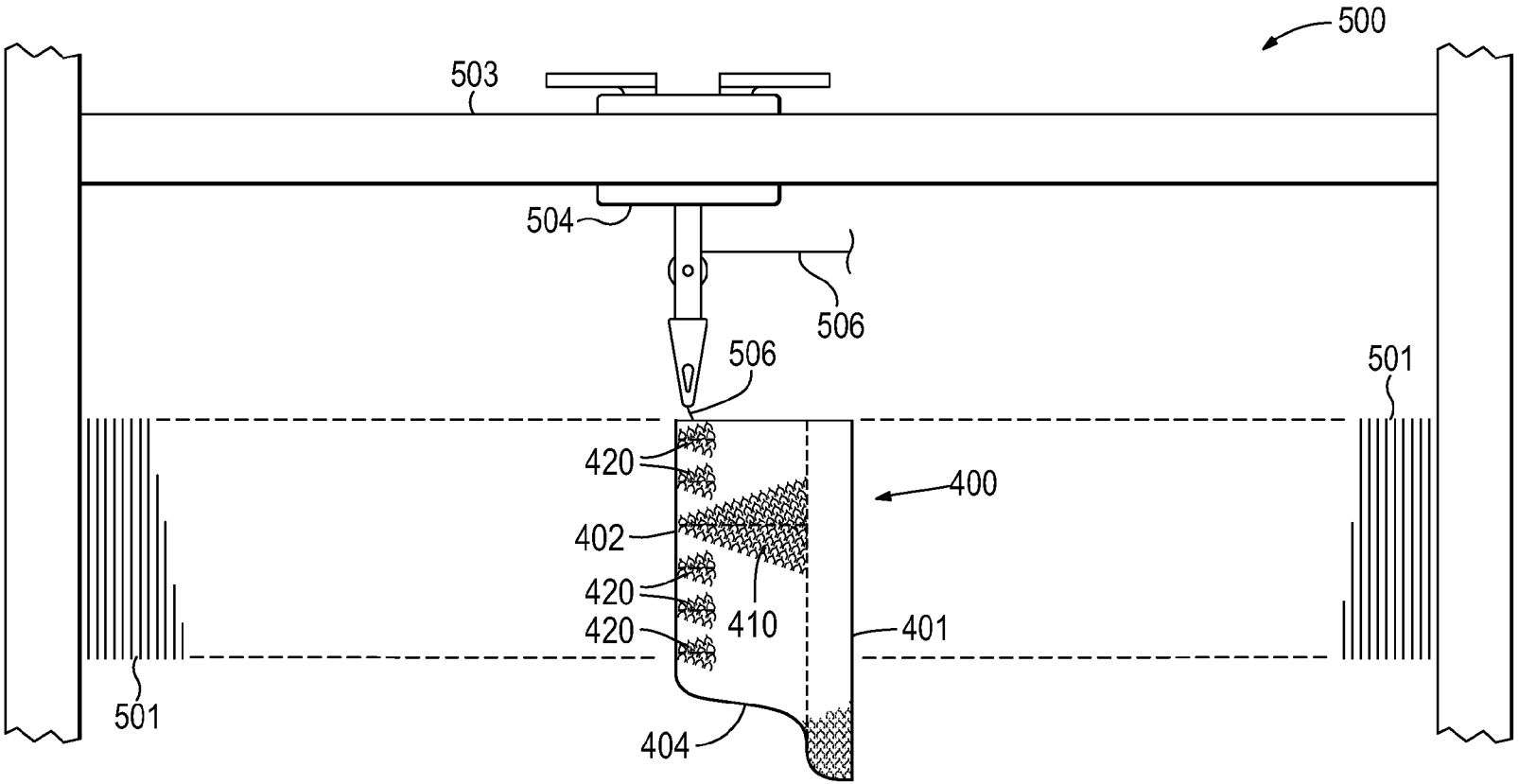
FIG. 19 is a schematic elevational view depicting a portion of a knitting process for forming the heel knitted component depicted in FIGS. 12 and 13.

The general process discussed above for forming gore region 410 may also be employed to form each of peripheral gore regions 420. Referring to FIG. 19, knitting machine 500 is depicted as forming the configuration of heel knitted component 400 depicted in FIG. 12. As with gore region 410, peripheral gore regions 420 may be formed by knitting a series of courses of decreasing length, and then knitting a series of courses of increasing length to form gores in each of peripheral gore regions 420 and along or adjacent to lower peripheral edge 402.

Figure 20:
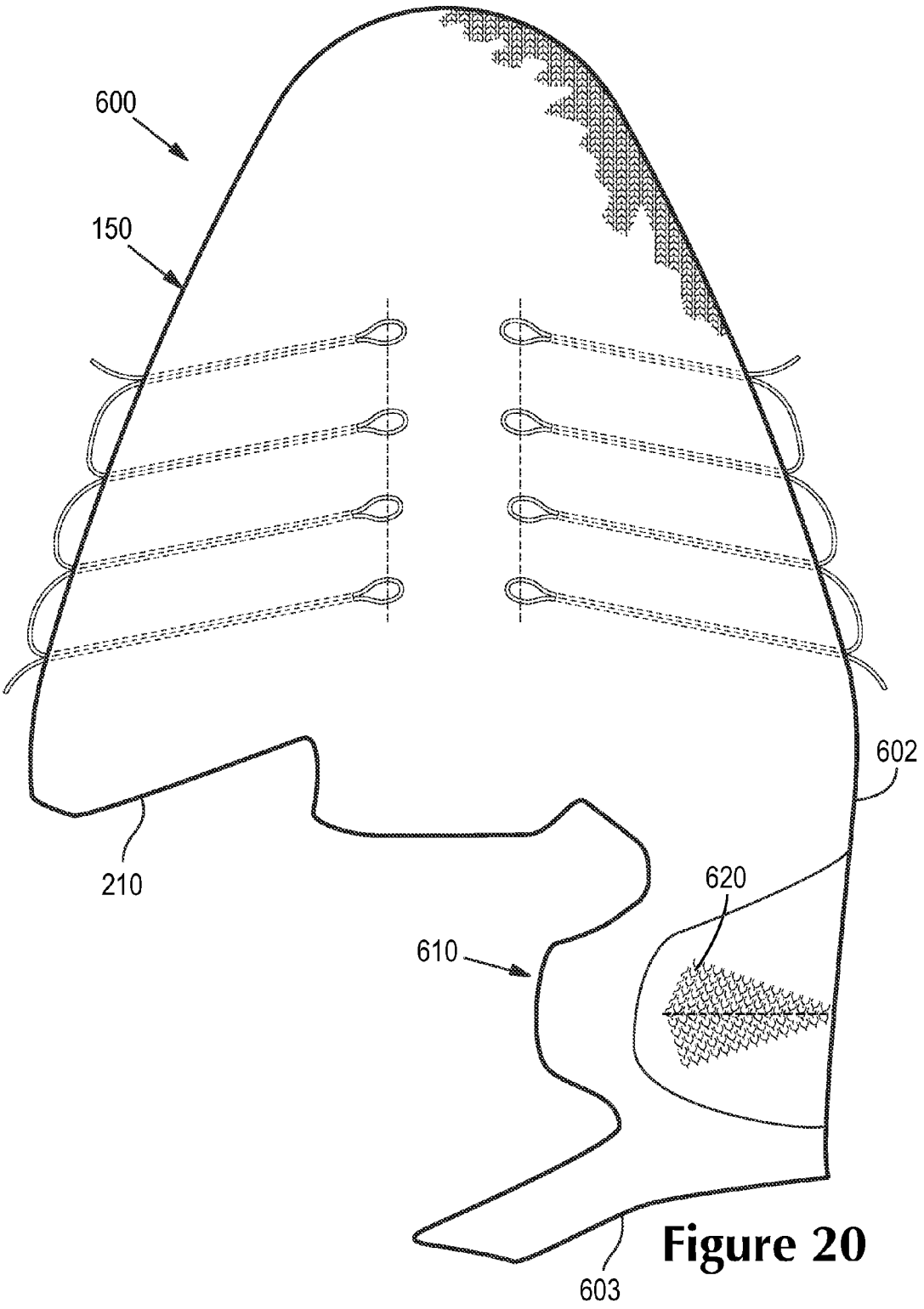
FIG. 20 is a plan view of a knitted component according to additional embodiments of the present disclosure.

In addition to forming knitted heel component 400, knitting machine 500 may be utilized to form other knitted components or combinations of knitted components. Referring to FIG. 20, for example, a knitted component 600 is depicted as including forward knitted component 150 and another heel knitted component 610 that are formed of unitary knit construction. That is, the combination of forward knitted component 150 and heel knitted component 610 are formed as a one-piece element through a knitting process. In this configuration, a peripheral edge 602 extends continuously from forward knitted component to heel knitted component 610 and may be secured to strobel 125 or sole structure 110. Moreover, a side edge 603 of heel knitted component 610 may be joined to rear edge 210 of forward knitted component 150 to form opening 121 when incorporating knitted component 600 into footwear 100. In addition, heel knitted component 610 includes a gore region 620. Accordingly, substantially all of upper 120, including a gore in gore region 620, may be formed of unitary knit construction through a single knitting process.

While various embodiments of the present disclosure have been described, the description is intended to be exemplary rather than limiting, and it will be apparent to those of ordinary skill in the art that many more embodiments and implementations are possible that are within the scope of the present disclosure. Accordingly, the present disclosure is not to be restricted except in light of the attached claims and their equivalents. Also, various modifications, combinations, and changes of the features described herein may be made within the scope of the attached claims. As used in the claims, "any of" when referencing the previous claims is intended to mean (i) any one claim, or (ii) any combination of two or more claims referenced.

What is claimed is:

1. An article of footwear having an upper and a sole structure secured to the upper, the upper comprising a knitted component that includes at least one gore region located in a heel region of the article of footwear; wherein the heel region comprises a top edge and a bottom edge and wherein the at least one gore region extends vertically through a majority of a distance from the bottom edge towards the top edge, and a plurality of spaced apart second gore regions;

wherein at least one of the plurality of second gore regions is located on one of a medial side and a lateral side of the first gore region, and another of the plurality of second gore regions is located on the other of the medial side and a lateral side of the first gore region; and wherein each of the plurality of second gore regions extend vertically from the bottom edge towards the top edge, and wherein the at least one gore region and the plurality of second gore regions are spaced apart from each other and each include a vertical center midline, and wherein the at least one gore region and the plurality of second gore regions includes a first series of courses of increasing length in a direction towards the midline and a second series of courses of decreasing length in a direction away from the midline.

2. The article of footwear recited in claim 1, wherein the at least one gore region is larger than each of the plurality of second gore regions.

3. The article of footwear recited in claim 2, wherein the at least one gore region extends through a majority of a distance between the bottom edge and the top edge of the heel region, and the plurality of second gore regions extend through less than one-third of the distance between the bottom edge and the top edge of the heel region.

4. The article of footwear recited in claim 2, wherein the second gore regions form a series of gores extending upwards from the bottom edge of the heel region.

5. The article of footwear recited in claim 1, wherein the upper includes a forward knitted component located in at least a forefoot region of the article of footwear, the forward knitted component and the heel region being joined together and forming a majority of the upper.

* * * * *